US006672704B2

(12) United States Patent
Katakura et al.

(10) Patent No.: US 6,672,704 B2
(45) Date of Patent: Jan. 6, 2004

(54) LIQUID EJECTING APPARATUS AND METHOD OF CLEANING AN EJECTION HEAD

(75) Inventors: Takahiro Katakura, Nagano (JP); Koji Morikoshi, Nagano (JP); Tsuyoshi Sano, Nagano (JP); Kiyohiko Takemoto, Nagano (JP); Kaoru Momose, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/987,653

(22) Filed: Nov. 15, 2001

(65) Prior Publication Data

US 2002/0060713 A1 May 23, 2002

(30) Foreign Application Priority Data

| | | |
|---|---|---|
| Nov. 15, 2000 | (JP) | P.2000-348313 |
| Dec. 21, 2000 | (JP) | P.2000-389327 |
| Mar. 28, 2001 | (JP) | P.2001-091599 |
| Apr. 5, 2001 | (JP) | P.2001-106930 |
| Nov. 13, 2001 | (JP) | P.2001-347149 |

(51) Int. Cl.[7] ..... B41J 2/165
(52) U.S. Cl. ..... 347/23; 347/23
(58) Field of Search ..... 347/23, 29, 30, 347/33, 14, 10, 11, 68, 70, 72, 92

(56) References Cited

U.S. PATENT DOCUMENTS 5,479,196 A * 12/1995 Inada ..... 347/92
5,670,997 A * 9/1997 Sugimoto et al. ..... 347/30
6,126,261 A * 10/2000 Yamanaka ..... 347/12

FOREIGN PATENT DOCUMENTS

| | | | |
|---|---|---|---|
| EP | 0 850 765 A2 * | 7/1998 | |
| JP | 62-113555 | 5/1987 | ..... B41J/3/04 |
| JP | 64-001552 | 1/1989 | ..... B41J/3/04 |
| JP | 9-295411 | 11/1997 | ..... B41J/3/04 |

OTHER PUBLICATIONS

Abstracts of Japan, 64–001552, Jan. 5, 1989.

Abstracts of Japan, 62–113555, May 25, 1987.

* cited by examiner

*Primary Examiner*—Shih-Wen Hsieh
(74) *Attorney, Agent, or Firm*—Sughrue Mion, PLLC

(57) ABSTRACT

A nozzle surface (13) is sealed by a cap member (44) in a state in which an ink solution is accumulated in a sealed hollow portion (45). After the nozzle surface (13) is sealed, piezoelectric vibrators (35) are driven by applying thereto a high-frequency drive signal of a frequency higher than a drive frequency for ejecting the ink solution toward recording paper, thereby causing cavitation in the ink solution. The firmly adhering thickened ink and solidified ink occurring in nozzle openings (29) are broken or exfoliated by bubbles caused by this cavitation. Subsequently, the suction operation is performed to remove the thickened ink and the solidified ink from the nozzle portions.

66 Claims, 19 Drawing Sheets

LIQUID EJECTING APPARATUS AND METHOD OF CLEANING AN EJECTION HEAD

BACKGROUND OF THE INVENTION

The present invention relates to a liquid ejecting apparatus having an ejection head capable of ejecting a liquid from a nozzle opening, and a method of cleaning the ejection head.

As liquid ejecting apparatuses for ejecting a liquid from a nozzle opening, there are an ink-jet type recording apparatus capable of ejecting an ink solution onto a printing recording medium, a filter manufacturing apparatus for manufacturing a color filter by ejecting color materials of red, green, and blue onto the surface of a glass substrate, and a liquid-crystal injecting apparatus for injecting a liquid crystal of a predetermined amount into grids making up picture elements.

Hereafter, a description will be given of the related art with reference to an example of the ink-jet type recording apparatus which is a kind of liquid ejecting apparatus.

In this ink-jet type recording apparatus, an ink solution is ejected from nozzle openings by the actuation of pressure generating elements. These nozzle openings are very small through holes. For this reason, when the thickening of the liquid occurs in the vicinities of the nozzle openings, there occur such problems that the jet speed of the liquid changes and that the jet direction becomes curved.

To prevent such trouble, various recovering operation is performed in the ink-jet type recording apparatus. For example, the so-called flushing operation is carried out in which ink droplets are ejected immediately before the recording operation so as to eliminate thickened ink. In addition, the so-called fine vibration operation for allowing the ink in the vicinities of the nozzle openings to slightly flow to disperse the thickened ink in the ink cartridge and the suction cleaning for sucking the ink solution in a recording head through the nozzle openings are also carried out. Further, JP-A-9-295411 discloses an apparatus in which the aforementioned flushing operation is effected at a frequency higher than a frequency at which drive pulses are generated at the time of recording.

The aforementioned operations exhibit advantages in cases where the thickened liquid located in close proximity to a nozzle surface is eliminated. However, in cases where the viscosity of the liquid increases in deep recesses of the nozzle openings or the degree of thickening is high, it is difficult to eliminate the thickened liquid by these operations.

SUMMARY OF THE INVENTION

The invention has been devised to overcome the above-described problems, and its object is to provide a liquid ejecting apparatus capable of eliminating a thickened liquid in the vicinities of the nozzle openings, as well as a method of cleaning an ejection head.

In order to solve the aforesaid object, the invention is characterized by having the following arrangement.

(1) A liquid ejecting apparatus comprising:

an ejection head including a nozzle opening capable of ejecting a liquid, a pressure generating chamber communicating to the nozzle opening, and a pressure generating element for changing a pressure in the liquid inside the pressure generating chamber;

a drive signal generator for generating a drive signal including a drive pulse to be applied to the pressure generating element;

an application controller for controlling an application of the drive signal to the pressure generating element; and a suction unit for sucking the liquid in the ejection head through the nozzle opening, wherein the drive signal generator is capable of generating a first drive signal which is used when the liquid is ejected toward an object of ejection and a second drive signal which is used at the time of the cleaning operation of the ejection head and whose frequency at which a drive pulse is generated is higher than that of the first drive signal, and wherein the suction unit is actuated in association with the application of the second drive signal to the pressure generating element.

(2) The liquid ejecting apparatus according to (1), wherein the suction unit includes a cap member having a sealed hollow portion which is open to a nozzle surface side of the ejection head, a negatively pressurizing unit communicating to the cap member to negatively pressurize the sealed hollow portion, and a negative-pressurization controller for controlling the actuation of the negatively pressurizing unit, and the nozzle surface is sealed with the nozzle opening opposed to an interior of the sealed hollow portion, and the negatively pressurizing unit is actuated in the sealed state to suck the liquid inside the ejection head.

(3) The liquid ejecting apparatus according to (1), wherein the suction unit is actuated after the application of the second drive signal to the pressure generating element.

(4) The liquid ejecting apparatus according to (1), wherein the suction unit is actuated during the second drive signal is applied to the pressure generating element.

(5) The liquid ejecting apparatus according to (2), wherein the cap member is capable of being disposed at a position spaced apart from the nozzle surface in a state that the sealed hollow portion is opposed to the nozzle surface, and the application controller applies the second drive signal to the pressure generating element in the spaced-apart state.

(6) The liquid ejecting apparatus according to (2), wherein the application controller applies the second drive signal to the pressure generating element in a state that the nozzle surface is sealed by the cap member.

(7) The liquid ejecting apparatus according to (6), wherein the application controller applies the second drive signal to the pressure generating element in a state that the liquid is accumulated in the sealed hollow portion.

(8) The liquid ejecting apparatus according to (7), wherein the liquid is accumulated in the sealed hollow portion by actuating the negatively pressurizing unit in a state that the nozzle surface is sealed by the cap member.

(9) The liquid ejecting apparatus according to (8), wherein the liquid accumulated in the sealed hollow portion and the nozzle surface are brought into contact with each other in the state that the nozzle surface is sealed by the cap member.

(10) The liquid ejecting apparatus according to (6), wherein an opening-closing valve whose opening and closing are controlled by the negative-pressurization controller is provided midway in an open-to-atmosphere passage having one end communicating to the sealed hollow portion of the cap member and another end open to the atmosphere, and the negative-pressurization controller closes the opening-closing valve in the state that the nozzle surface is sealed by the cap member, and the negative-pressurization controller opens the opening-closing valve and actuates the negatively pressurizing unit when the sealing of the nozzle surface is released.

(11) The liquid ejecting apparatus according to (1), wherein the application controller intermittently applies the second drive signal to the pressure generating element a plurality of times.

(12) The liquid ejecting apparatus according to (1), wherein the application controller is capable of selecting pressure generating elements to which the second drive signal is applied.

(13) The liquid ejecting apparatus according to (12), wherein the ejection head has a plurality of nozzle blocks each having a common liquid supply source, and the application controller applies the second drive signal to each unit of the pressure generating elements belonging to the nozzle block.

(14) The liquid ejecting apparatus according to (13), wherein the suction unit is capable of sucking the liquid for each nozzle block.

(15) The liquid ejecting apparatus according to (12), wherein the ejection head has a plurality of nozzle rows each having nozzle openings formed in a row, and the application controller applies the second drive signal alternately to odd-numbered nozzle openings and even-numbered nozzle openings which belong to one nozzle row.

(16) The liquid ejecting apparatus according to (1), wherein the application controller periodically effects application of the second drive signal and suction by the suction unit.

(17) The liquid ejecting apparatus according to (16), wherein an elapsed-time measuring unit is provided for measuring the time elapsed from the time of previous actuation of the suction unit, and the application controller applies the second drive signal to the pressure generating element on condition that the elapsed time measured by the elapsed-time measuring unit reaches a reference value for judgment.

(18) The liquid ejecting apparatus according to (1), wherein an ejection-number counter is provided for counting the number of ejection of the liquid, and the application controller applies the second drive signal to the pressure generating element on condition that the number of ejection counted by the ejection-number counter reaches a reference value for judgment.

(19) The liquid ejecting apparatus according to (17), wherein the application controller sets the reference value for judgment by incorporating liquid-type information indicative of a type of liquid.

(20) The liquid ejecting apparatus according to (17), wherein an environmental-condition detector is provided which is capable of detecting at least one of a temperature and humidity of a vicinity of the ejection head, and the application controller sets the reference value for judgment by incorporating a result of detection by the environmental-condition detector.

(21) The liquid ejecting apparatus according to (1), wherein the application controller applies the second drive signal on condition that the application controller receives an instruction signal for instructing the supply of the second drive signal.

(22) The liquid ejecting apparatus according to (1), wherein a suction-force limiter is provided for limiting the suction force of the suction unit, and the suction-force limiter is arranged to be capable of being actuated in interlocking relation to the actuation of the suction unit.

(23) The liquid ejecting apparatus according to (1), wherein a wiping mechanism for wiping the nozzle surface is provided.

(24) The liquid ejecting apparatus according to (1), wherein at least one of a generation period and a drive voltage of the drive pulse is capable to be varied.

(25) The liquid ejecting apparatus according to (1), wherein the frequency at which the drive pulse is generated in the second drive signal is set to not less than 30 kHz and not more than 200 kHz.

(26) The liquid ejecting apparatus according to (1), wherein the frequency at which the drive pulse is generated in the second drive signal is set to not less than 80 kHz and not more than 120 kHz.

(27) The liquid ejecting apparatus according to (1), wherein the drive voltage of the drive pulse which the second drive signal has is set to a voltage value at which the liquid is not ejected.

(28) The liquid ejecting apparatus according to (1), wherein the drive voltage of the drive pulse which the second drive signal has is set to a voltage value at which the liquid is ejected.

(29) The liquid ejecting apparatus according to (1), wherein the pressure generating element is a piezoelectric vibrator.

(30) A liquid ejecting apparatus comprising:

an ejection head including a nozzle opening capable of ejecting a liquid, a pressure generating chamber communicating to the nozzle opening, and a pressure generating element for changing a pressure in the liquid inside the pressure generating chamber;

a first drive signal generator for generating a first drive signal including a drive pulse to be applied to the pressure generating element and used when the liquid is ejected toward an object of ejection;

a suction unit for sucking the liquid in the ejection head through the nozzle opening;

a vibration applying element for applying vibration to the liquid inside the pressure generating chamber by vibrating in a period according to the applied drive signal; and a second drive signal generator for generating a second drive signal including a drive pulse to be applied to the pressure generating element, whose frequency at which a drive pulse is generated is higher than that of the first drive signal; and an application controller for controlling an application of the second drive signal to the pressure generating element;

wherein the suction unit is actuated in association with the application of the second drive signal to the pressure generating element.

(31) The liquid ejecting apparatus according to (30), wherein the suction unit includes a cap member having a sealed hollow portion which is open to a nozzle surface side of the ejection head, a negatively pressurizing unit communicating to the cap member to negatively pressurize the sealed hollow portion, and a negative-pressurization controller for controlling the actuation of the negatively pressurizing unit, and the nozzle surface is sealed with the nozzle opening opposed to an interior of the sealed hollow portion, and the negatively pressurizing unit is actuated in the sealed state to suck the liquid inside the ejection head.

(32) The liquid ejecting apparatus according to (30), wherein the suction unit is actuated after the application of the second drive signal to the pressure generating element.

(33) The liquid ejecting apparatus according to (30), wherein the suction unit is actuated during the second drive signal is applied to the pressure generating element.

(34) The liquid ejecting apparatus according to (33), wherein the cap member is capable of being disposed at a position spaced apart from the nozzle surface in a state that the sealed hollow portion is opposed to the nozzle surface, and the application controller applies the second drive signal to the pressure generating element in the spaced-apart state.

(35) The liquid ejecting apparatus according to (33), wherein the application controller applies the second drive signal to the pressure generating element in a state that the nozzle surface is sealed by the cap member.

(36) The liquid ejecting apparatus according to (35), wherein the application controller applies the second drive signal to the pressure generating element in a state that the liquid is accumulated in the sealed hollow portion.

(37) The liquid ejecting apparatus according to (36), wherein the liquid is accumulated in the sealed hollow portion by actuating the negatively pressurizing unit in a state that the nozzle surface is sealed by the cap member.

(38) The liquid ejecting apparatus according to (37), wherein the liquid accumulated in the sealed hollow portion and the nozzle surface are brought into contact with each other in the state that the nozzle surface is sealed by the cap member.

(39) The liquid ejecting apparatus according to (35), wherein an opening-closing valve whose opening and closing are controlled by the negative-pressurization controller is provided midway in an open-to-atmosphere passage having one end communicating to the sealed hollow portion of the cap member and another end open to the atmosphere, and the negative-pressurization controller closes the opening-closing valve in the state that the nozzle surface is sealed by the cap member, and the negative-pressurization controller opens the opening-closing valve and actuates the negatively pressurizing unit when the sealing of the nozzle surface is released.

(40) The liquid ejecting apparatus according to (30), wherein the application controller intermittently applies the second drive signal to the pressure generating element a plurality of times.

(41) The liquid ejecting apparatus according to (30), wherein the application controller periodically effects application of the second drive signal and suction by the suction unit.

(42) The liquid ejecting apparatus according to (41), wherein an elapsed-time measuring unit is provided for measuring the time elapsed from the time of previous actuation of the suction unit, and the application controller applies the second drive signal to the pressure generating element on condition that the elapsed time measured by the elapsed-time measuring unit reaches a reference value for judgment.

(43) The liquid ejecting apparatus according to (30), wherein an ejection-number counter is provided for counting the number of ejection of the liquid, and the application controller applies the second drive signal to the pressure generating element on condition that the number of ejection counted by the ejection-number counter reaches a reference value for judgment.

(44) The liquid ejecting apparatus according to (42), wherein the application controller sets the reference value for judgment by incorporating liquid-type information indicative of a type of liquid.

(45) The liquid ejecting apparatus according to (42), wherein an environmental-condition detector is provided which is capable of detecting at least one of a temperature and humidity of a vicinity of the ejection head, and the application controller sets the reference value for judgment by incorporating a result of detection by the environmental-condition detector.

(46) The liquid ejecting apparatus according to (30), wherein the application controller applies the second drive signal on condition that the application controller receives an instruction signal for instructing the supply of the second drive signal.

(47) The liquid ejecting apparatus according to (30), wherein a suction-force limiter is provided for limiting the suction force of the suction unit, and the suction-force limiter is arranged to be capable of being actuated in interlocking relation to the actuation of the suction unit.

(48) The liquid ejecting apparatus according to (30), wherein a wiping mechanism for wiping the nozzle surface is provided.

(49) The liquid ejecting apparatus according to (30), wherein at least one of a generation period and a drive voltage of the drive pulse is capable to be varied.

(50) The liquid ejecting apparatus according to (30), wherein the frequency at which the drive pulse is generated in the second drive signal is set to not less than 30 kHz and not more than 200 kHz.

(51) The liquid ejecting apparatus according to (30), wherein the frequency at which the drive pulse is generated in the second drive signal is set to not less than 80 kHz and not more than 120 kHz.

(52) The liquid ejecting apparatus according to (30), wherein the pressure generating element is a piezoelectric vibrator.

(53) The liquid ejecting apparatus according to (30), wherein the vibration applying element is attached to the ejection head.

(54) The liquid ejecting apparatus according to (30), wherein the vibration applying element is provided so as to be capable of abut against the ejection head.

(55) The liquid ejecting apparatus according to (30), wherein the first and second drive signal generator is formed integrally.

(56) The liquid ejecting apparatus according to (30), wherein the first and second drive signal generator is formed separately.

(57) A method of cleaning an ejection head having a pressure generating chamber communicating to a nozzle opening for ejecting a liquid and a pressure generating element for changing a pressure in the liquid inside the pressure generating chamber, the method comprising the steps of:

applying to the pressure generating element a second drive signal whose frequency at which a drive pulse is generated is higher than a first drive signal which is used when the liquid is ejected toward an object of ejection; and sucking the liquid in the ejection head through the nozzle opening in association with the supply of the second drive signal.

(58) The method according to (57), wherein the second drive signal is applied in a state that the liquid flows out from the nozzle opening.

(59) The method according to (58), wherein the liquid in head ejection head is sucked during the second drive signal is applied to the pressure generating element.

(60) A method of cleaning an ejection head having a pressure generating chamber communicating to a nozzle opening for ejecting a liquid, a pressure generating element for changing a pressure in the liquid inside the pressure generating chamber, and a vibration applying element for applying vibration to the liquid inside the pressure generating chamber, the method comprising the steps of:

applying to the pressure generating element a second drive signal whose frequency at which a drive pulse is generated is higher than a first drive signal which is used when the liquid is ejected toward an object of ejection; and sucking the liquid in the ejection head through the nozzle opening in association with the supply of the second drive signal.

(61) The method according to (60), wherein the second drive signal is applied in a state that the liquid flows out from the nozzle opening.

(62) The method according to (61), wherein the liquid in head ejection head is sucked during the second drive signal is applied to the pressure generating element.

The present disclosure relates to the subject matter contained in Japanese patent application Nos. 2000-348313 (filed on Nov. 15, 2000), 2000-389327 (filed on Dec. 21, 2000), 2001-091599 (filed on Mar. 28, 2001), 2001-106930 (filed on Apr. 5, 2001), which are expressly incorporated herein by reference in its entirety.

BRIEF DESCRIPTION OF THE DRAWINGS

FIG. 21A shows a state that a cap member is separated from a nozzle surface; and FIG. 21B show a state that the cap member is brought in close contact with the nozzle surface.

DETAILED DESCRIPTION OF PREFERRED EMBODIMENTS

Figure 1:
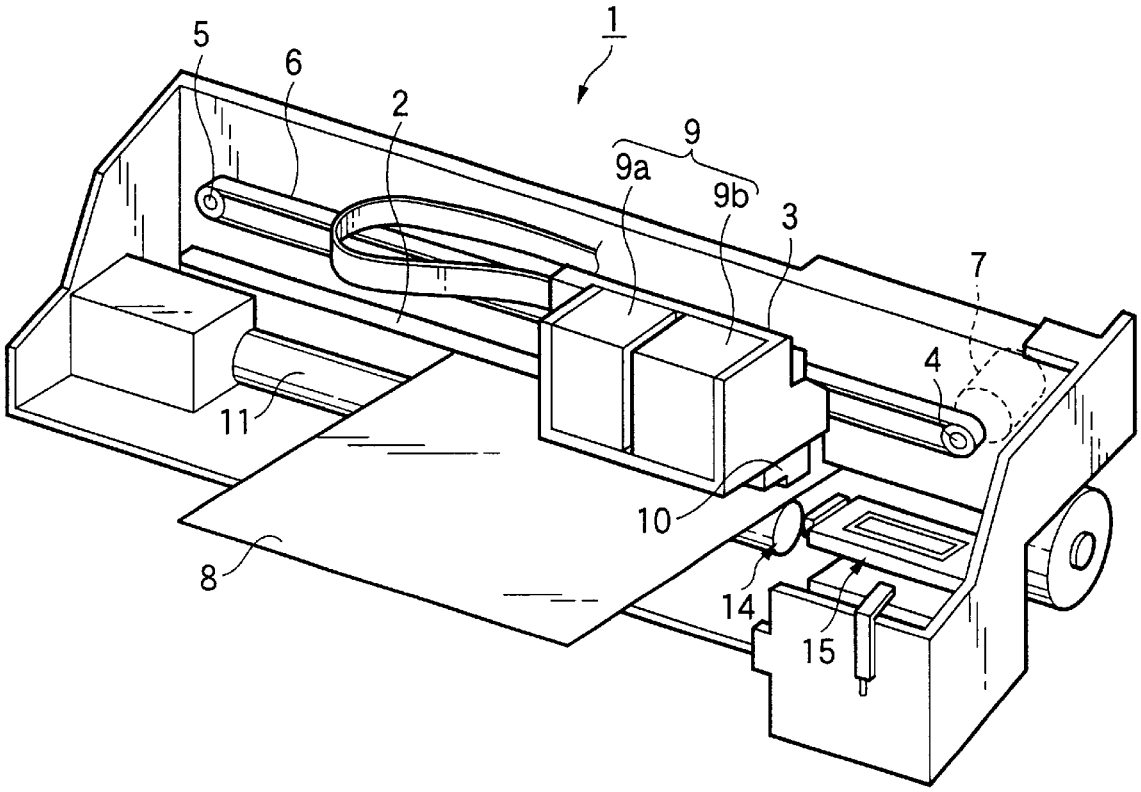
FIG. 1 is a perspective view of an ink jet printer.

Referring now to the drawings, a description will be given of an embodiment of the invention. Here, FIG. 1 is a perspective view of an ink jet printer 1 (hereafter, simply referred to as the printer 1) which is a kind of a liquid jet printer.

The illustrated printer 1 includes a carriage 3 mounted movably on a guide shaft 2 and a timing belt 6 extending between a drive pulley 4 and an idle pulley 5. The carriage 3 is connected to the timing belt 6, and the drive pulley 4 is joined to a rotating shaft of a pulse motor 7. Therefore, when the pulse motor 7 is driven, the carriage 3 is moved in the widthwise direction of recording paper 8 (a kind of printing and recording medium).

The carriage 3 is provided with a cartridge holder portion, and an ink cartridge 9 is detatchably mounted in this cartridge holder portion. A recording head 10 as a kind of the ejection head in the present invention is attached to the lower surface of the carriage 3 opposed to the recording paper 8. A paper feed roller 11 is disposed below the guide shaft 2 in parallel to the guide shaft 2. As a paper feed motor 12 (see FIG. 5) is driven, the paper feed roller 11 is rotated to transport the recording paper 8.

A home position is set outside a recording area within the moving range of the carriage 3, and the recording head 10 is positioned at this home position during the period of waiting for recording operation or the like. A wiping mechanism 14 for wiping a nozzle surface 13 (see FIG. 2) of the recording head 10 and a capping mechanism 15 for sealing this nozzle surface 13 are disposed at this home position in a horizontally juxtaposed manner. In this embodiment, the wiping mechanism 14 is disposed on a side close to the recording paper 8, while the capping mechanism 15 is disposed on a farther side.

Figure 2:
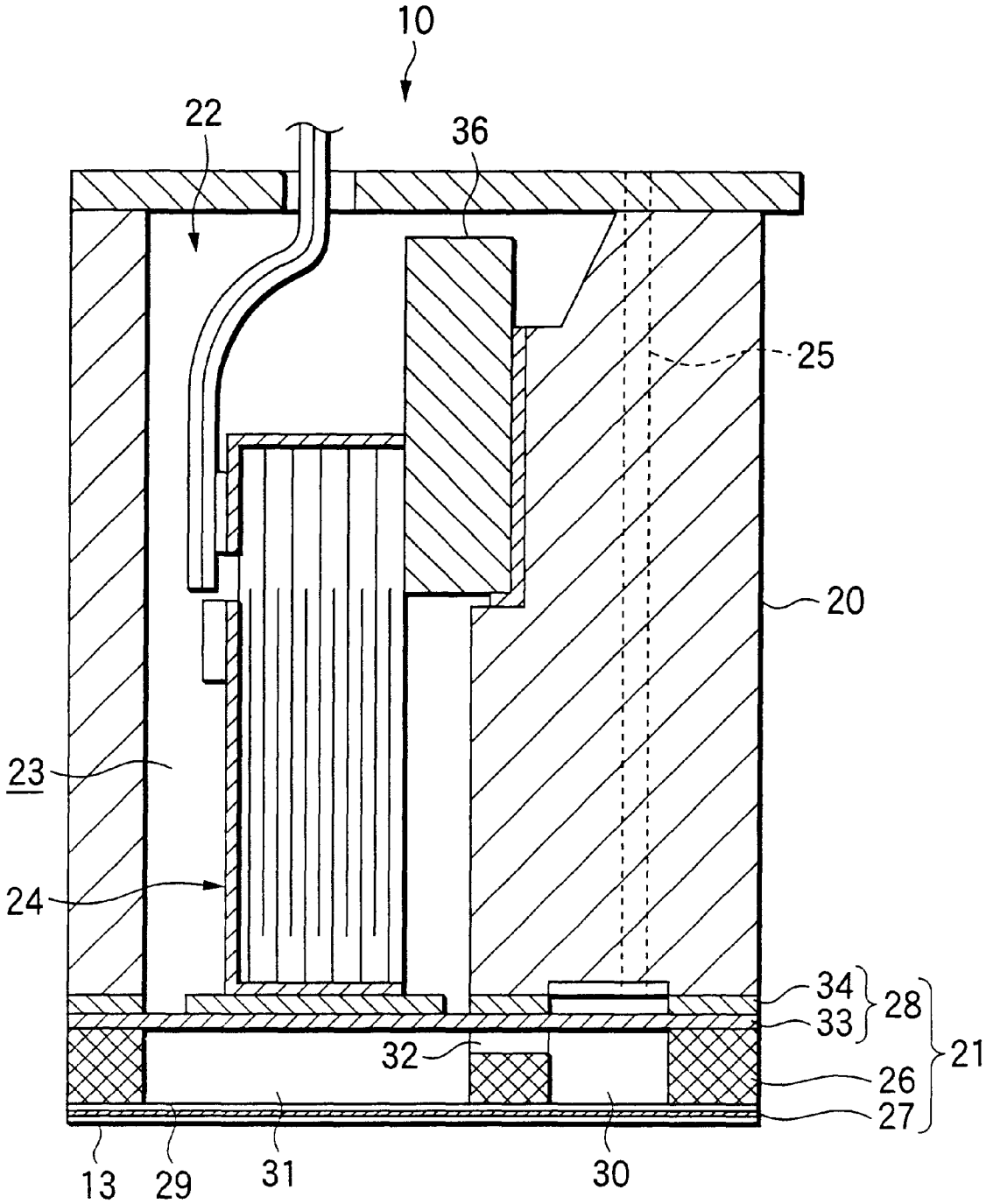
FIG. 2 is a cross-sectional view of a recording head.

Next, a description will be given of the recording head 10. As shown in FIG. 2, the recording head 10 is mainly constituted by a casing 20, a channel unit 21, and a vibrator unit 22.

The casing 20 is a block-shaped member formed of a synthetic resin and includes therein an accommodating hollow portion 23 whose front and rear ends open, the channel unit 21 being joined to the front end. The vibrator unit 22 is accommodated and fixed in the accommodating hollow portion 23 in a state that a teeth-like distal end of a group of vibrators 24 is opposed to the front end-side opening. An ink supply pipe 25 for supplying an ink solution from the ink cartridge 9 is provided on a side of the accommodating space portion 23.

The channel unit 21 is constituted by a channel forming plate 26, a nozzle plate 27, and an elastic plate 28.

The nozzle plate 27 is a thin plate-like member in which a multiplicity of (e.g., 96) nozzle openings 29 are arrayed in rows and at pitches corresponding to the density of dot formation. The nozzle plate 27 is made of, for example, a stainless steel plate. The multiplicity of nozzle openings 29 arrayed in one row constitute a nozzle row. In this embodiment, a plurality of the nozzle rows are provided in correspondence with the colors of the ink solutions. Further, an outer surface of the nozzle plate 27 functions as the aforementioned nozzle surface 13.

A reservoir 30 into which the ink solution supplied through the ink supply pipe 25 flows, a pressure chamber 31 (corresponds to a pressure generating chamber) for generating ink pressure necessary for ejecting ink droplets communicating to the nozzle opening 29, an ink supply port 32 for communicating the reservoir 30 to the pressure chamber 31, and the like are formed in the channel forming plate 26. Further, in this embodiment, these respective portions 30, 31, and 32 are formed by subjecting a silicon wafer to etching.

The elastic plate 28 has a double structure in which an elastic film 33 is formed on a supporting plate 34. In the supporting plate 34, a compliance portion corresponding to the reservoir 30 and a diaphragm portion corresponding to the pressure chamber 31 are removed by etching or the like.

Figure 3:
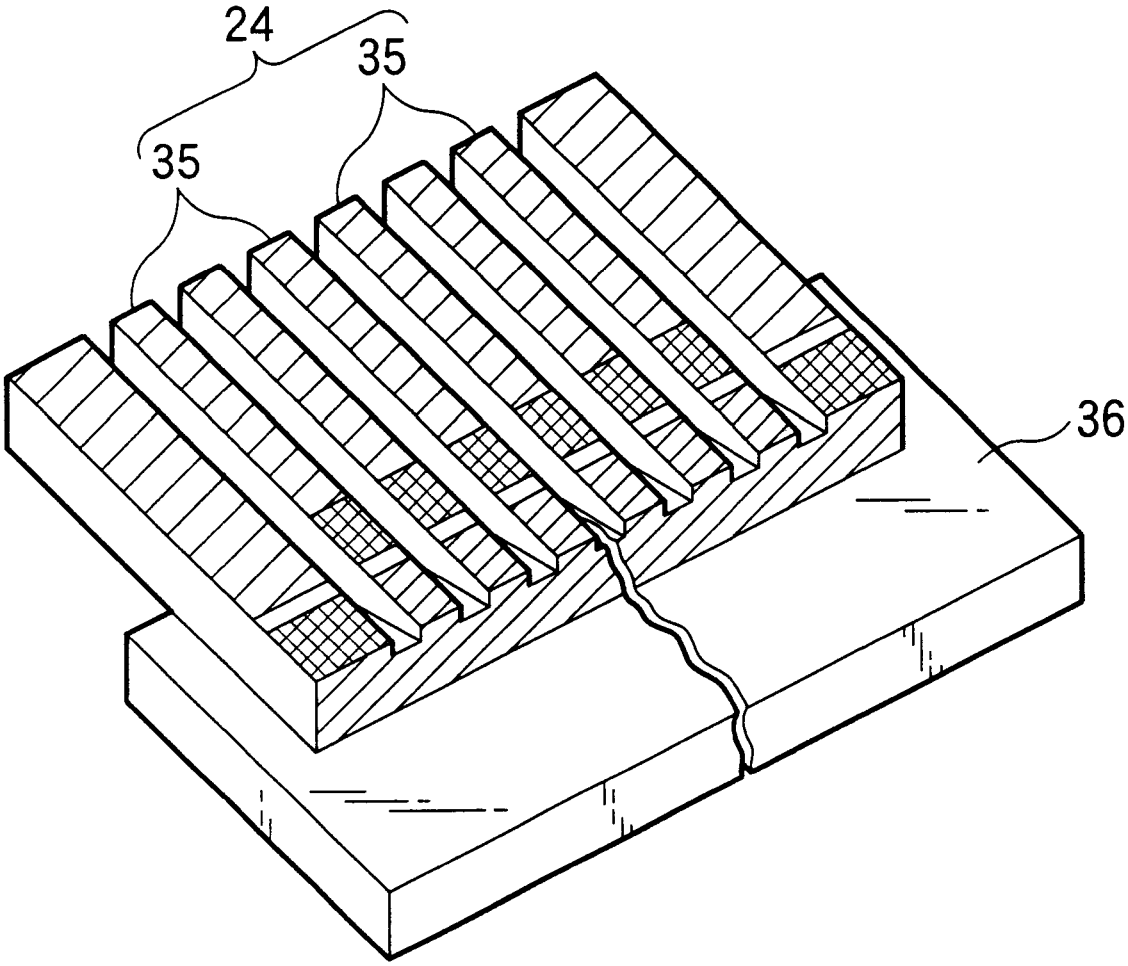
FIG. 3 is a perspective view of a vibrator unit.

As shown in FIG. 3, the vibrator unit 22 is mainly constituted by the group of vibrators 24 including a plurality of piezoelectric vibrators 35 and a fixed plate 36. The piezoelectric vibrators 35 constituting the group of vibrators 24 are formed in a comb shape, and are cut and divided into small widths of, e.g., 50 μm to 100 μm or thereabouts. In addition, the fixed plate 36 is formed by such as a stainless steel plate with a thickness of 2 mm or thereabouts.

In the recording head 10 thus constructed, a series of ink channels is formed which leads from the ink supply pipe 25 to the nozzle opening 29 through the reservoir 30 and the pressure chamber 31.

If the respective piezoelectric vibrators 35 of the group of vibrators 24 are extended and contracted in the longitudinal direction of the elements, the volume of the pressure chamber 31 changes, so that the ink pressure within the pressure chamber 31 can be changed. By controlling this ink pressure, it is possible to eject ink droplets from the nozzle openings 29. By displacing a meniscus (a free surface of the ink solution exposed at the nozzle opening 29) between the pressure chamber side and the nozzle surface side, it is possible to disperse the thickened ink in the vicinities of the nozzle openings 29.

With this recording head 10, it is known that there are the following three major types of natural vibration modes which affect the ejection of ink droplets. Namely, the first is the natural vibration mode of the aforementioned meniscus, the second is the natural vibration mode of the pressure chamber 31, and the third is the natural vibration mode of the piezoelectric vibrator 35.

If the period of natural vibration concerning the meniscus is assumed to be Tm, this period of natural vibration Tm can be expressed by the following formula (1):

$$Tm=2\pi((Mnoz\times Msup)\times Cnoz)^{1/2} \quad (1)$$

where Mnoz is the inertial resistance at the nozzle portion, Msup is the inertial resistance at the ink supply port 32, Cnoz is the stiffness compliance of the ink solution in the nozzle opening 29.

In addition, if the period of natural vibration concerning the pressure chamber 31 is assumed to be Tc, this period of natural vibration Tc can be expressed by the following formula (2):

$$Tc=2\pi((Mnoz\times Msup)(Cvib+Cink)/(Mnoz+Msup)^{1/2} \quad (2)$$

where Cvib is the stiffness compliance of the pressure chamber 31, and Cink is the stiffness compliance of the ink solution in the pressure chamber 31.

If the period of natural vibration concerning the piezoelectric vibrator 35 is assumed to be Tp, this period of natural vibration Tp can be expressed by the following formula (3):

$$Tp=2\pi(Mp\times Cp)^{1/2} \quad (3)$$

where Mp is the inertial resistance at the piezoelectric vibrator 35, and Cp is the stiffness compliance of the piezoelectric vibrator 35.

If the dimensions of the size of the recording head 10 and values of the physical properties of the ink solution are substituted in these formulae (1) to (3), it is possible to determine the respective periods of natural vibration Tm, Tc, and Tp. In this example, Tm was approximately 100 μsec, Tc was approximately 10 μsec, and Tp was approximately 5 μsec. Therefore, since the period of natural vibration Tp concerning the piezoelectric vibrator 35 was approximately 5 μsec, the piezoelectric vibrator 35 can be driven at a driving frequency of 200 kHz at maximum in this example.

Ink solutions of a plurality of colors are separately stored in the ink cartridge 9. In this embodiment, the ink cartridge 9 includes a black ink cartridge 9*a* storing a black ink and a color ink cartridge 9*b* storing chromatic color inks such as a cyan ink, a magenta ink, a yellow ink, and the like.

It should be noted that these ink solutions are pigment-based ink solutions using pigments as color materials, but dye-based ink solutions using dyes as color materials may be also used in a similar manner.

When each ink cartridge 9 is loaded in the cartridge holder portion, an ink supply needle (not shown) provided in the cartridge holder portion is inserted in the ink cartridge 9. Since this ink supply needle communicates with the ink supply pipe 25, the ink solutions in the ink cartridges 9 are supplied to the recording head 10 side as the ink cartridges 9 are loaded.

Figure 4A:
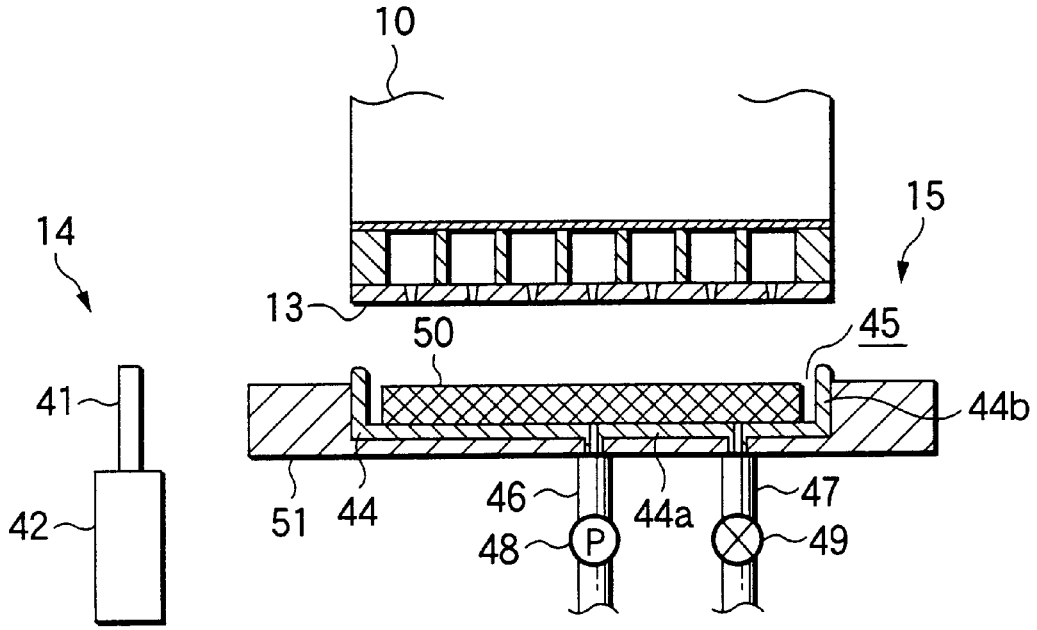
FIGS. 4A and 4B are diagrams explaining the construction of a wiping mechanism and a capping mechanism.
Figure 4B:
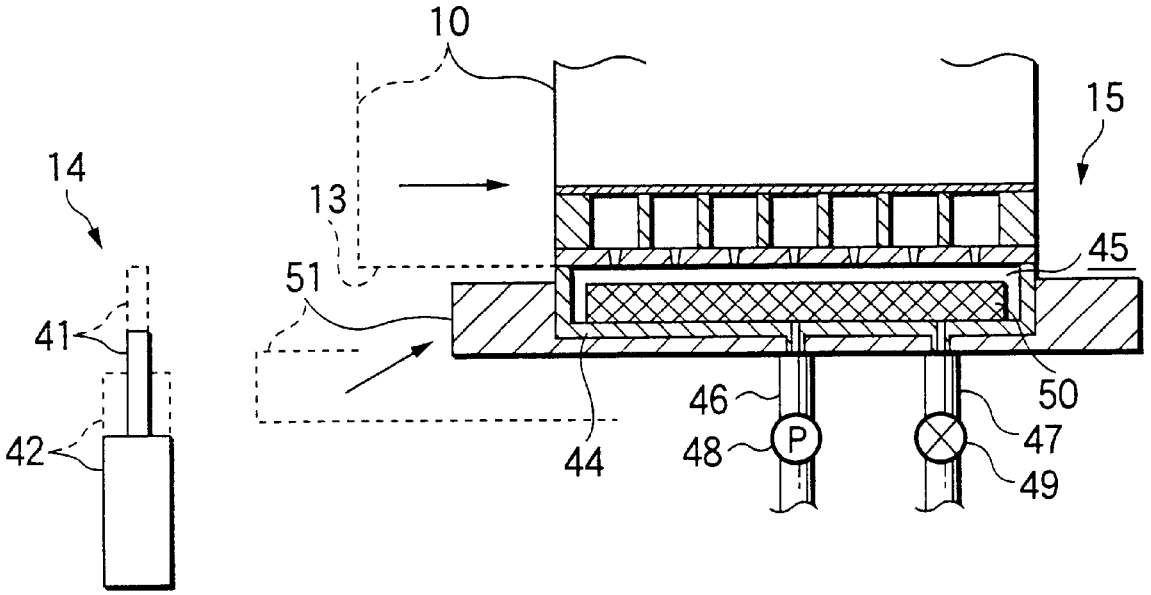

The above-described wiping mechanism 14 functions as a wiping unit in the invention. As shown in FIGS. 4A and 4B, this wiping mechanism 14 comprises a wiper blade 41, a wiper holder 42 for holding the wiper blade 41, a wiper lifting/lowering driving source 43 (see FIG. 5) for vertically moving the wiper holder 42, and the like.

The wiper blade 41 is formed as a plate-like member in which a water-repellant elastic member such as rubber and a liquid-absorbing member such as felt or sponge are laminated, and the ink solution wiped off by the elastic member is absorbed by the liquid-absorbing member.

The wiper holder 42 is a member for holding a lower half portion of the wiper blade 41, and is constituted by, for example, a synthetic resin-made, box-shaped having an upper side open. The wiper lifting/lowering driving source 43 is constituted by, for example, an electromagnet and an attracted portion which is attracted to this electromagnet (neither are shown). In this embodiment, the attracted portion is disposed on the wiper holder 42 side, and the electromagnet is disposed at an appropriate position above this attracted portion.

In this wiping mechanism 14, the electromagnet is normally demagnetized. In this demagnetized state, the wiper holder 42 and the wiper blade 41 are positioned at a lower limit of their movable range due to their own weight. At this lower-limit position, as shown by the solid lines in FIG. 4B, an upper edge of the wiper blade 41 is set at a position slightly lower than the nozzle surface 13 of the recording head 10.

Meanwhile, when a command for execution of the wiping operation is issued, the electromagnet is magnetized. In this magnetized state, the attracted portion is attracted upward by the magnetic force generated by the electromagnet, so that the wiper holder 42 moves to an upper limit of its movable range. At this upper-limit position, as shown by the dotted lines in FIG. 4B, the upper edge of the wiper blade 41 is set at a position slightly higher than the nozzle surface 13.

Accordingly, if the recording head 10 is moved to a position opposed to the wiper blade 41, the upper edge of the wiper blade 41 comes into contact with the nozzle surface 13. In this state of contact, if the recording head 10 is reciprocated along the guide shaft 2, the wiper blade 41 moves relatively to wipe off the ink solution and the like attached to the nozzle surface 13. Then, after this wiping operation is finished, the electromagnet is demagnetized to release the state of contact between the wiper blade 41 and the nozzle surface 13.

The capping mechanism 15 constitutes a part of a sucking unit. As shown in FIGS. 4A and 4B, the capping mechanism 15 is constituted by: a cup-shaped cap member 44; a suction passage 46 and an open-to-atmosphere passage 47 which communicate with a sealed hollow portion 45 at the bottom of the cap member 44; a suction pump 48 provided midway in the suction passage 46 and functioning as a negatively pressurizing unit of the invention; an opening-closing valve 49 provided midway in the open-to-atmosphere passage 47; a moisture retention sheet 50 disposed in the sealed hollow portion 45; and a cap lifting mechanism (not shown) for vertically moving the cap member 44.

The cap member 44 is a member defining the sealed hollow portion 45 with its upper surface on the recording head 10 side open. This cap member 44 has a bottom portion 44*a* formed by a rectangular plate member and four upright wall portions 44*b* standing uprightly from peripheral edges of the bottom portion 44*a*. The bottom portion 44*a* and the upright wall portions 44*b* define and form the sealed hollow portion 45. Close-contact portions having substantially V-shaped sections, for enhancing the sealing characteristic for the nozzle surface 13, are provided projectingly on the upper surface of the upright wall portions 44*b*, respectively. The area of the opening of the sealed hollow portion 45 is formed with such a size that the respective nozzle rows in the nozzle plate 27 can face the interior of the sealed hollow portion 45.

This cap member 44 is made by molding an elastic member such as rubber into a cup shape, and is held on a slider 51. In addition, the moisture retention sheet 50 which is fitted in the sealed hollow portion 45 is formed by a liquid-absorbing material such as felt or sponge which is capable of absorbing and retaining a liquid. The thickness of the moisture retention sheet 50 in this embodiment is formed to be slightly thinner than the height of the sealed hollow portion 45. For this reason, the upper surface of the moisture retaining sheet 50 is slightly spaced apart downwardly from the nozzle surface 13 in a state that the nozzle surface 13 is sealed by the cap member 44, as shown in FIG. 4B.

The suction passage 46 is a channel where the air or the ink solution is allowed to flow by the actuation of the suction pump 48, and is formed by a resin-made tube, for example. An ink trap (not shown) for collecting the ink solution is provided midway in this suction passage 46 downstream of the suction pump 48. A downstream end of the suction passage 46 is open to the atmosphere. The suction pump 48 is arranged to take in the ink solution and air from a suction port on the sealed hollow portion 45 side and to discharge the ink solution and the like thus taken in from a discharge port on the ink trap side.

This suction pump 48 may be constructed in any way insofar as it is capable of sending the ink solution and air. In this embodiment, a so-called "squeeze-type" pump is used in which the resin-made tube making up the suction passage 46 is nipped by a pair of rollers, and by moving the rollers along the tube, the air and the like inside tube are discharged from the end of the tube.

Then, if the suction pump 48 is actuated in the state that the nozzle surface 13 is sealed by the cap member 44, the interior of the sealed hollow portion 45 is set under negative pressure, thereby sucking the ink solution and air discharged to the sealed hollow portion 45. It should be noted that this sucked ink solution is collected by the ink trap.

The open-to-atmosphere passage 47 is a channel for the air for making the interior of the sealed hollow portion 45 open to the atmosphere, and one end thereof communicates to the sealed hollow portion 45, while the other end thereof is open to the atmosphere. This open-to-atmosphere passage 47 is made by a resin-made tube in the same way as the aforementioned suction passage 46. The opening-closing valve 49 provided midway in this open-to-atmosphere passage is constituted by a valve whose open and closed states can be electrically controllable, such as a solenoid valve.

The cap lifting mechanism is a mechanism for vertically moving the cap member 44 as described above, and in this embodiment the cap lifting mechanism is constituted by a guide projection provided on the cap member 44 side (e.g., the slider 51) as well as a cam mechanism which is formed by such as the supporting plate 34 provided with a guide groove capable of guiding this guide projection (neither are shown).

When the carriage 3 is moved from the recording area side toward the cap member 44 side, an abutment portion on the carriage 3 side abuts against the cap member 44 to move the cap member 44 together with the carriage 3 in the direction of the main scanning direction. As a result of this movement, the guide projection is guided by the guide groove, and the cap member 44 moves diagonally upward.

When the cap member 44 moves to a standby position, the close-contact portions provided on the upper surface of the upright wall portions 44*b* are brought into close contact with the nozzle surface 13 of the recording head 10 to effect sealing, as shown in FIG. 4B. In this sealed state, the respective nozzle openings 29 are opposed to the interior of the sealed hollow portion 45, so that the evaporation of an ink solvent from the nozzle openings 29 is prevented. In addition, if the aforementioned suction pump 48 is operated in the state that sealing is effected by the cap member 44, the interior of the sealed hollow portion 45 is set under negative pressure, thereby allowing the ink solution in the recording head 10 to be discharged through the nozzle openings 29.

Between the abutment starting position between the abutment portion and the cap member 44, and the aforementioned standby position, the cap member 44 is disposed at a position spaced apart from the nozzle surface 13 in the state that the sealed hollow portion 45 is opposed to the nozzle surface 13. Accordingly, in this embodiment, by controlling the position of the carriage 3, it is possible to move the cap member 44 away from or into close contact with the nozzle surface 13.

Figure 5:
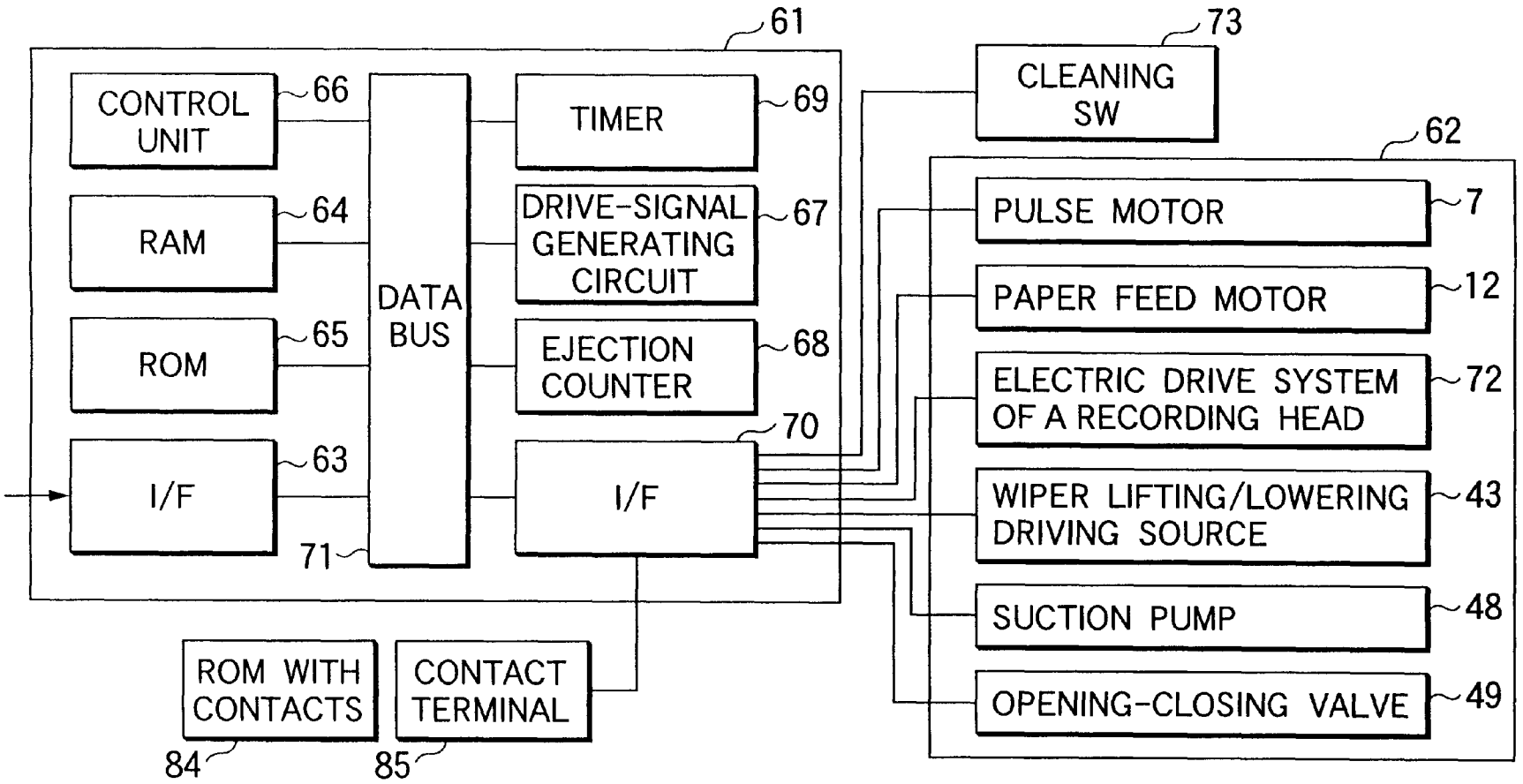
FIG. 5 is a block diagram explaining the electrical configuration of the printer.

Next, a description will be given of the electrical configuration of the printer 1. As shown in FIG. 5, the illustrated printer 1 includes a printer controller 61 and a print engine 62.

The print controller 61 comprises: an interface 63 (external I/F 63) for receiving print data and the like from an unillustrated host computer or the like; a RAM 64 for storing various data and the like; a ROM 65 storing such as a control routine for the processing of various data; a control unit 66 constituted by a CPU and the like; a drive signal generating circuit 67 for generating a drive signal to be applied to the piezoelectric vibrators 35; an ejection counter 68 for counting the number of ejection of the ink solution; a timer 69 for counting the time elapsed from the point of time the cleaning operation (which will be described later) was executed previously; an interface 70 (internal I/F 70) for sending the drive signal and various control signals to the print engine 62 side; and a data bus 71 for electrically connecting these various parts.

On the other hand, the print engine 62 comprises: the pulse motor 7 serving as a carriage driving source for moving the carriage 3; the paper feed motor 12 for rotating the paper feed roller 11; an electric drive system 72 of the recording head 10; the wiper lifting/lowering driving source 43; the suction pump 48; and the opening-closing valve 49 and the like.

The electric drive system 72 of the recording head 10 together with the aforementioned control unit 66 functions as a printing controller of the invention, and selectively applies drive signals from the drive signal generating circuit 67 to the piezoelectric vibrators 35. This electric drive system 72 may be constructed in any way in so far as it is capable of controlling the application of the drive signal to the piezoelectric vibrators 35. In this embodiment, this electric drive system 72 is constituted by a shift register, a latch circuit, a switching circuit, and the like.

The aforementioned control unit 66 is a portion for effecting control in this printer 1, and controls various parts of the print engine 62. For example, in control of the recording operation, the control unit 66 generates dot-pattern data on the basis of the print data from the unillustrated host computer, and transfers the generated dot-pattern data to the electric drive system 72 of the recording head 10. In addition, the control unit 66 also moves the carriage 3 by operating the pulse motor 7 and transports the recording paper 8 by operating the paper feed motor 12.

At the time of the cleaning operation of the recording head 10, the control unit 66 functions as a cleaning controller, and controls the wiper lifting/lowering driving source 43, the suction pump 48, the opening-closing valve 49, the pulse motor 7, and the like. At this time, the control unit 66 also functions as a negative-pressurization controller for controlling the suction pump 48 serving as the negatively pressurizing unit. Accordingly, this control unit 66 constitutes the suction unit of the invention together with the capping mechanism 15.

Further, the control unit 66 also serves as a mode setting unit, and sets a mode by selecting from a cleaning mode for applying high-frequency vibration to the ink solutions and a print mode (a kind of ejection mode) capable of recording dots on the recording paper 8. Namely, the control unit 66 normally sets the print mode, but in cases where the printer 1 has been left as it is for a long period of time without being used, or the number of ejection of the ink solution has exceeded a predetermined number, the control unit 66 set the cleaning mode.

For example, the control unit 66 monitors an alarm signal from the aforementioned timer 69, and upon receiving this alarm signal, the control unit 66 sets the cleaning mode. This timer 69 functions as the elapsed-time measuring unit of the invention, and measures the time elapsed from the point of time the cleaning operation was finished previously. Therefore, when this elapsed time has exceeded a reference value for judgment, the timer 69 outputs an alarm signal, and is reset when the cleaning operation is completed. In addition, after the reset, the timer 69 counts again the time elapsed from the point of time of the completion.

The aforementioned reference value for judgment is set to a relatively long period of, for example, several weeks to several months or thereabouts. Further, as this reference value for judgment, the same value may be set uniformly, but the value may be varied for each type of the ink solution. This is because there are differences in the degrees of solidification and the precipitation of the pigment depending on the type of ink. For example, a pigment-based ink solution tends to be more easily solidified than a dye-based ink solution. Incidentally, in this embodiment, the reference value for judgment is set to 1000 hours.

In this case, information of the type of ink of the ink solution used and a corresponding reference value for judgment are stored in a predetermined region in the ROM 65, for example. Accordingly, this ROM 65 functions as the ink-type storage unit.

An arrangement may be provided such that a temperature sensor and a humidity sensor (neither are shown) are provided to make it possible to detect the temperature and humidity in the vicinity of the recording head 10, and the detected results are inputted to the control unit 66, and the reference value for judgment may be set by incorporating the thus-detected temperature and humidity. In this case, the temperature sensor and the humidity sensor function as the environmental-conditions detector, and detect the temperature, humidity and the like which constitute the operating environment of the printer 1. It should be noted that as for the temperature sensor and the humidity sensor, it suffices if at least one of them is provided.

In addition, the aforementioned ejection counter 68 functions as an ejection-number counter of the invention, and counts the number of ejection of the ink solution from the point of time the cleaning operation was finished previously. This ejection counter 68 counts, for example, the number of ejection of the ink solution (ink droplets) every type of ink.

When the number of ejection exceeds a reference value for judgment, the ejection counter 68 outputs an alarm signal representative of that result to the control unit 66. Then, upon receipt of this alarm signal, the control unit 66 sets the cleaning mode. It should be noted that when the cleaning mode is completed, this ejection counter 68 is also reset, and counts again the number of ejection from the point of time of the completion.

The aforementioned reference value for judgment is set to, for example, tens of thousands to hundreds of millions of times or thereabouts. As for this reference value for judgment as well, the same value may be set uniformly, but the value may be varied for each type of the ink solution in the same way as the reference value for judgment concerning the period. In this case as well, the type of ink solution and the reference value for judgment are stored in a predetermined region of the ROM 65. Incidentally, the reference value for judgment in this embodiment is set to 100,000,000 times.

Furthermore, the control unit 66 monitors an instruction command from a cleaning switch 73, and upon receipt of this instruction signal the control unit 66 sets the cleaning mode. Namely, this instruction signal functions as a signal for instructing the execution of the cleaning operation (i.e., application of the high-frequency drive signal, which will be described later, to the piezoelectric vibrators 35).

The drive signal generating circuit 67 is a kind of drive signal generator of the invention, and generates a drive signal to be supplied to the piezoelectric vibrators 35. The drive signal generating circuit 67 in this embodiment is capable of generating a plurality of different drive signals in correspondence with modes which can be set. Namely, the drive signal generating circuit 67 is capable of generating an ejection drive signal (corresponding to a first drive signal of the invention) for ejecting ink droplets and a high-frequency drive signal (corresponding to a second drive signal of the invention) for driving the piezoelectric vibrator 35 at a high frequency.

Figure 6:
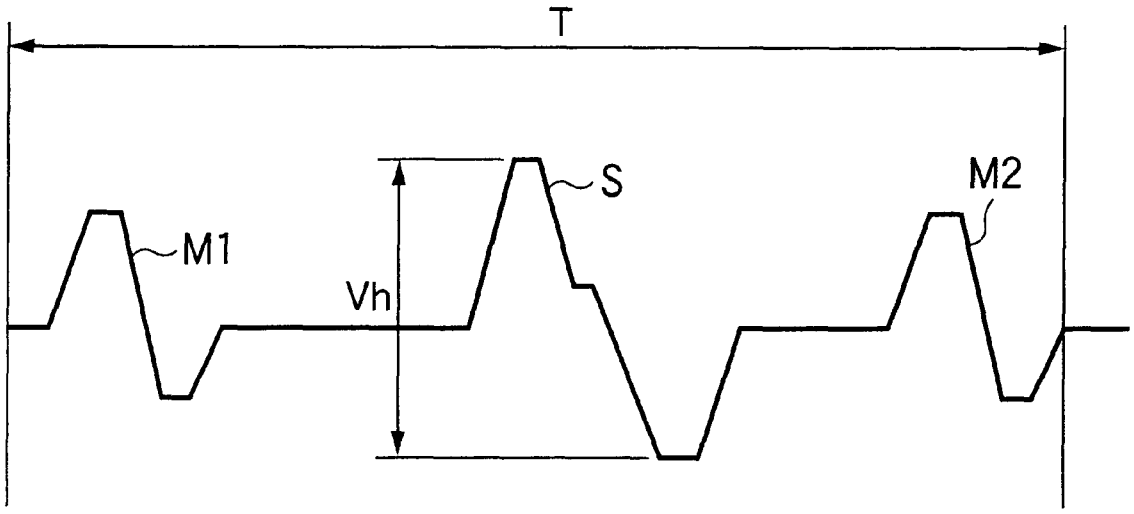
FIG. 6 is a diagram explaining the waveform of an ejection drive signal.

The ejection drive signal is a signal which is shown in FIG. 6, for example, and contains in a recording period T a series of pulses including a first medium-dot ejection pulse M1 used in recording of a large dot and a medium dot, a small-dot ejection pulse S used in recording of a small dot, and a second medium-dot ejection pulse M2 used in recording of a large dot.

In the case of recording a small dot by this ejection drive signal, the small-dot ejection pulse S is selected and applied to the piezoelectric vibrator 35. Similarly, in the case of recording a medium dot, the first medium-dot ejection pulse M1 is selected and applied to the piezoelectric vibrator 35. In addition, in the case of recording a large dot, the first medium-dot ejection pulse M1 and the second medium-dot ejection pulse M2 are selected and applied to the piezoelectric vibrator 35.

Figure 7:
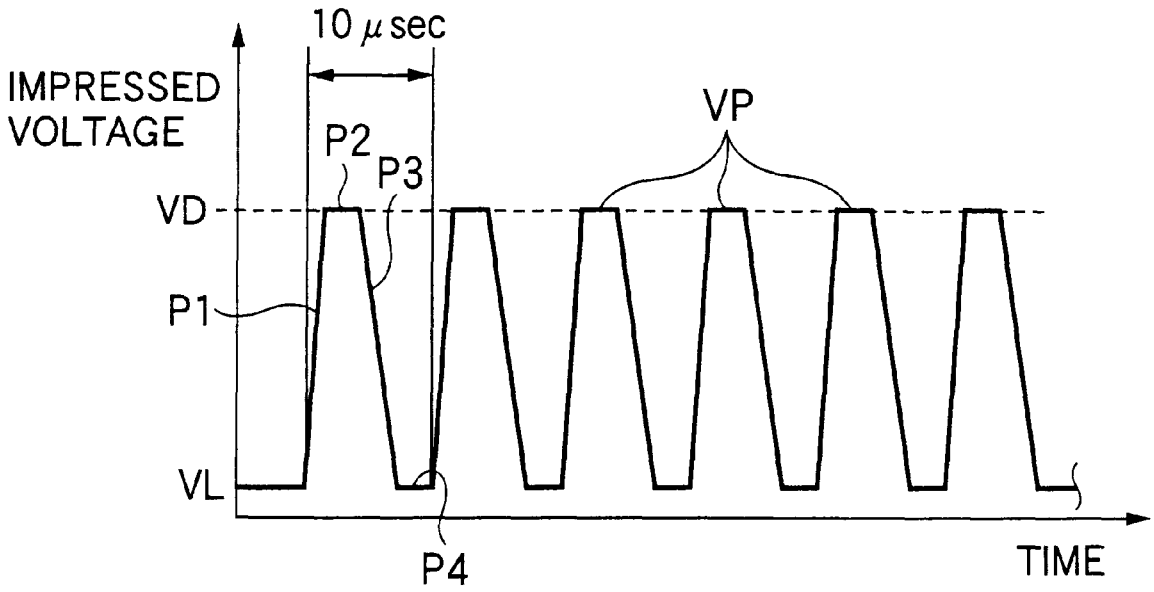
FIG. 7 is a diagram explaining a high-frequency drive signal.

The high-frequency drive signal is a signal which is shown in FIG. 7, for example, and is constituted by a drive pulse VP which is repeatedly generated at a high frequency. This drive pulse VP is a trapezoidal signal including a raising element P1 for raising the potential with a fixed gradient from a minimum potential VL to a drive potential VD, an upper holding element P2 for holding the drive potential VD, a lowering element P3 for lowering the potential with a fixed gradient from the drive potential VD to the minimum potential VL, and a lower holding element P4 for holding the minimum potential VL.

Then, the "high frequency" means a frequency of such a measure as to be able to cause the exfoliating action with respect to foreign objects such as the thickened ink and the precipitated pigment.

If this high-frequency drive signal is supplied to the piezoelectric vibrator 35, pressure vibration is excited in the ink solution in the pressure chamber 31. The period of this pressure vibration is shorter than the period of natural vibration based on the vibration mode of the meniscus and the vibration mode of the pressure chamber 31. Therefore, the ink pressure is decreased to saturation vapor pressure due to the sudden pressure change, and the ink vaporizes, so that a cavity is produced, that is the so-called cavitation occurs.

Bubbles generated due to this cavitation phenomenon apply an impulsive force to the thickened ink, solidified ink, deposits, and the like in the nozzle openings 29. Thus, this impulsive force breaks or decomposes the solidified ink, deposits, and the like, and promotes their exfoliation from the wall surfaces of the nozzle openings 29.

Here, the force F for breaking or exfoliating the solidified ink, deposits, and the like is proportional to a value obtained by multiplying a displacement δ and a frequency fp of the piezoelectric vibrator 35. Accordingly, for the purpose of eliminating the solidified ink, it is desirable to make the displacement δ and the frequency fp as large as possible.

However, if the displacement δ and the frequency fp are increased, applied energy becomes undeesirably large, there arises the need to enlarge the capacity of the power source, which in turn leads to an increase of the recording apparatus and increased cost.

Accordingly, the displacement δ of the piezoelectric vibrator 35 and the frequency fp are set to optimum values in correspondence with the required characteristics of the printer 1. By taking this aspect into consideration, in this embodiment, the drive pulse VP is generated at a frequency of 100 kHz. However, the drive pulse VP is not limited to this frequency, and may be set in a range from tens of kilohertz to a limit of response of the piezoelectric vibrator 35. For instance, the drive pulse VP can be set to an arbitrary value between 30 kHz and 200 kHz, and is more preferably set to a value between 80 kHz and 120 kHz if the balance between the eliminating effect and heat generation is taken into consideration.

In addition, concerning the drive pulse VP included in the high-frequency drive signal, in this embodiment, this drive voltage is set to such a level as not to allow the ink solution to be ejected.

Next, a description will be given of the operation of the printer 1 constructed as described above, more particularly the cleaning operation of the recording head 10.

When power is turned on, the control unit 66 sets the print mode and controls the printing operation. In this print mode, the control unit 66 controls the drive signal generating circuit 67 to generate the ejection drive signal explained with reference to FIG. 6. In addition, the control unit 66, while controlling the printing operation, monitors whether or not a condition for transfer to the cleaning mode becomes valid.

For example, the control unit 66 monitors alarm signals outputted from the aforementioned timer 69 and ejection counter 68, and determines that a condition for transfer becomes valid based on condition of the receipt of one of these alarm signals. The control unit 66 also determines that the condition for transfer becomes valid in cases where control unit 66 receives a command signal from the cleaning switch or it receives a transfer command sent from the host computer by such as the operation of software for setting.

Figure 8A:
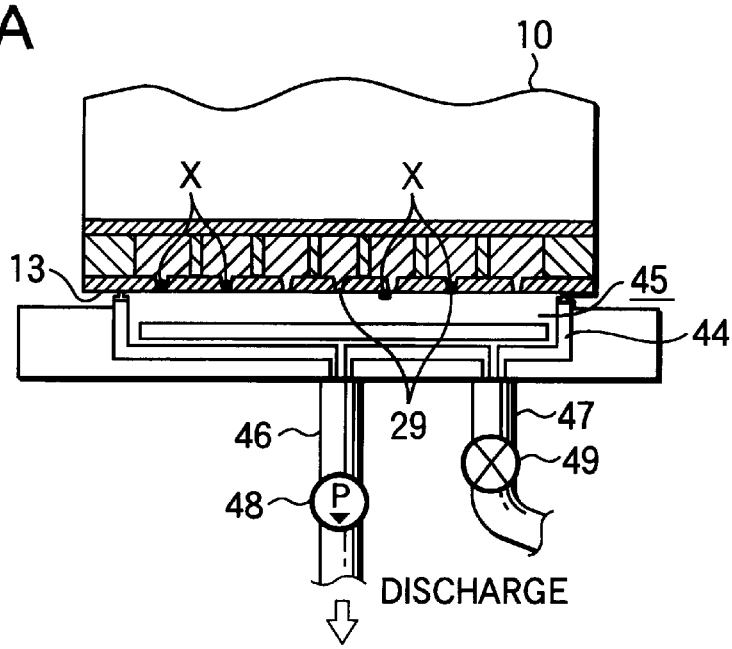
FIGS. 8A to 8C are schematic diagrams explaining the cleaning operation.

As the condition for transfer to the cleaning mode has become valid, the control unit 66 functions as the cleaning controller, and causes the cleaning operation to be executed. In this embodiment, the control unit 66 first causes the carriage 3 to move to the home position to seal the nozzle surface 13 by the cap member 44, as shown in FIG. 8A.

After the nozzle surface 13 has been sealed, the control unit 66 causes the ink solution to be supplied into the sealed hollow portion 45. For example, the control unit 66 closes the opening-closing valve 49 to shut off the open-to-atmosphere passage 47, and then actuates the suction pump 48. Consequently, the interior of the sealed hollow portion 45 is set under negative pressure, so that the ink solution in the recording head 10 is sucked into the sealed hollow portion 45 through the nozzle openings 29. Then, when the sealed hollow portion 45 has been filled with the ink solution to such an extent that the nozzle surface 13 is brought into contact with the ink solution, the control unit 66 stops the suction pump 48.

When the suction pump 48 has been stopped, the control unit 66 controls the drive signal generating circuit 67 to generate the high-frequency drive signal explained shown in FIG. 7, and applies it to the piezoelectric vibrators 35.

Figure 8B:
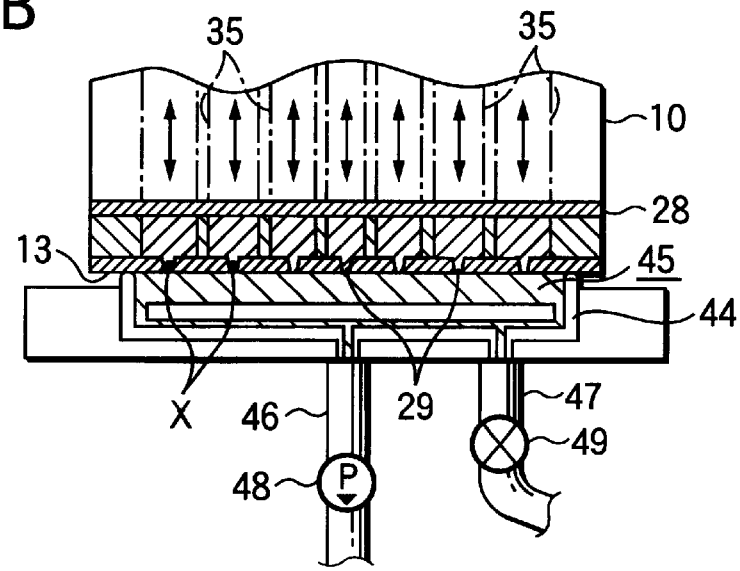

Consequently, as shown in FIG. 8B, the piezoelectric vibrators 35 are expanded and contracted and vibrate in correspondence with the supply of the drive signal. The vibrations from the piezoelectric vibrators 35 are propagated to the ink solution within the pressure chamber 31 through the elastic plate 28. Due to these vibrations, the adhesion of foreign objects X (e.g., the solidified ink, ink hardened together with paper dust and other dust, precipitated pigment) adhering to the interior of the nozzle openings 29 and the nozzle surface 13 is weakened, or these foreign objects X are separated.

Here, in this embodiment, since the high-frequency drive signal is supplied in the state that the ink solution is fully filled inside the cap, i.e., in the state that the ink solution is in contact with the overall nozzle openings 29, the vibrations are propagated through the ink solution inside the sealed hollow portion 45, thereby making it possible to weaken the adhesion of the foreign objects X more efficiently.

In addition, during the period when the vibrations are applied to the ink solution, the suction pump 48 is stopped and the opening-closing valve 49 is closed. For this reason, the ink solution does not flow out during this cleaning operation. Hence, the amount of ink solution required can be such an amount as to fill the sealed hollow portion 45, so that wasteful consumption of the ink solution can be suppressed.

In addition, since the driving source of the vibrations is the piezoelectric vibrators 35 used for ejecting the ink solution, it is unnecessary to provide an exclusive-use driving source, so that it is possible to attain simplification of the configuration of the apparatus. Further, it is also possible to apply large vibrational energy to the ink solution. In this embodiment, since 96 piezoelectric vibrators 35 in the same number as that of the nozzle openings 29 are provided in one nozzle row, by causing all the piezoelectric vibrators 35 to vibrate at a high frequency, it is possible to obtain necessary and sufficient large energy.

After the vibrations have been applied to the ink solution for a predetermined cleaning time, the ink solution inside the recording head 10 is discharged. This discharging of the ink solution is effected by actuating the suction pump 48. Namely, the interior of the sealed hollow portion 45 is set under negative pressure to suck out the ink solution inside the recording head 10 from the nozzle openings 29. As a result of the discharging of the ink solution, the adhesion is weakened or the exfoliated foreign objects X are eliminated in conjunction with the supply of the high-frequency drive signal.

When a necessary amount of the ink solution for the discharging of the foreign objects S is sucked out from the recording head 10, the ink solution inside the sealed hollow portion 45 is discharged. Here, the suction pump 48 is actuated, and the opening-closing valve 49 is changed over to the open state. Consequently, the ink solution inside the sealed hollow portion 45 is discharged through the suction passage 46, and is collected by the ink trap. In addition, air flows into the sealed hollow portion 45 through the open-to-atmosphere passage 47.

Since the opening-closing valve 49 is opened to allow air to flow into the sealed hollow portion 45 through the open-to-atmosphere passage 47 at the time of the discharging of the ink solution, when the sealing of the nozzle surface 13 is released, trouble such as the scattering of the ink solution can be reliably prevented, and the interior of the printer 1 can be kept in a clean state.

Upon completion of the discharging of the ink solution, the nozzle surface 13 is wiped by the wiping operation. After moving the wiper holder 42 to the upper-limit position, the control unit 66 moves the recording head 10 to the position opposing the wiper blade 41, and causes the recording head 10 to reciprocate in the main scanning direction. As a result, the wiper blade 41 relatively moves and wipes off the ink solution and the like adhering to the nozzle surface 13. At this time, even if the foreign objects X remain on the nozzle surface 13, since their adhesion to the recording head 10 has been weakened by the high-frequency vibrations, the foreign objects X can be wiped off the recording head 10 relatively easily.

Figure 8C:
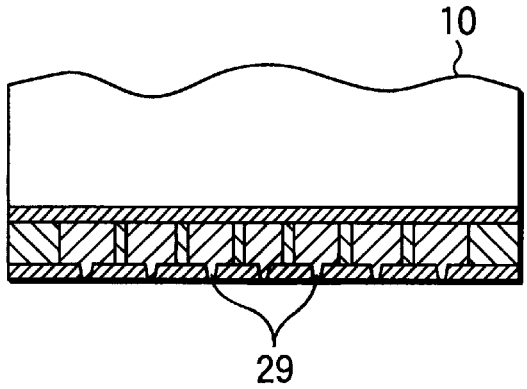

Thus, even after the foreign objects X remain after the application of the high-frequency vibrations, the foreign objects X can be removed by the ink-solution sucking operation and wiping operation, as shown in FIG. 8C.

In addition, since the separation of the foreign objects X can be promoted by imparting the high-frequency vibrations, it is possible to reduce the time durations of the ink-solution sucking operation and wiping operation. Furthermore, the operation of wiping the nozzle surface 13 can be omitted depending on the type of ink solution.

Thus, in this embodiment, since after the nozzle surface 13 is covered with the cap member 44 to effect sealing, the piezoelectric vibrators 35 are vibrated at a high frequency in the state that the ink solution is accumulated in the sealed hollow portion 45, even if the foreign objects X have been produced due to the evaporation of the ink solvent, the precipitation of the pigment, and the like, these foreign objects X can be reliably removed. In addition, since the removal of the foreign objects X is effected by using the ink solution accumulated in the sealed hollow portion 45, the ink solution is made difficult to be wasted, thereby making it possible to suppress the amount of consumption of the ink solution.

Incidentally, in the above-described first embodiment,the ink solution is not allowed to flow out from the nozzle openings 29 at the time of the supply of the high-frequency drive signal. However, the ink solution may be allowed to flow out from the nozzle openings 29 while the high-frequency drive signal is being supplied. Hereafter, a description will be given of a second embodiment which is constructed in such a following manner.

Figure 9:
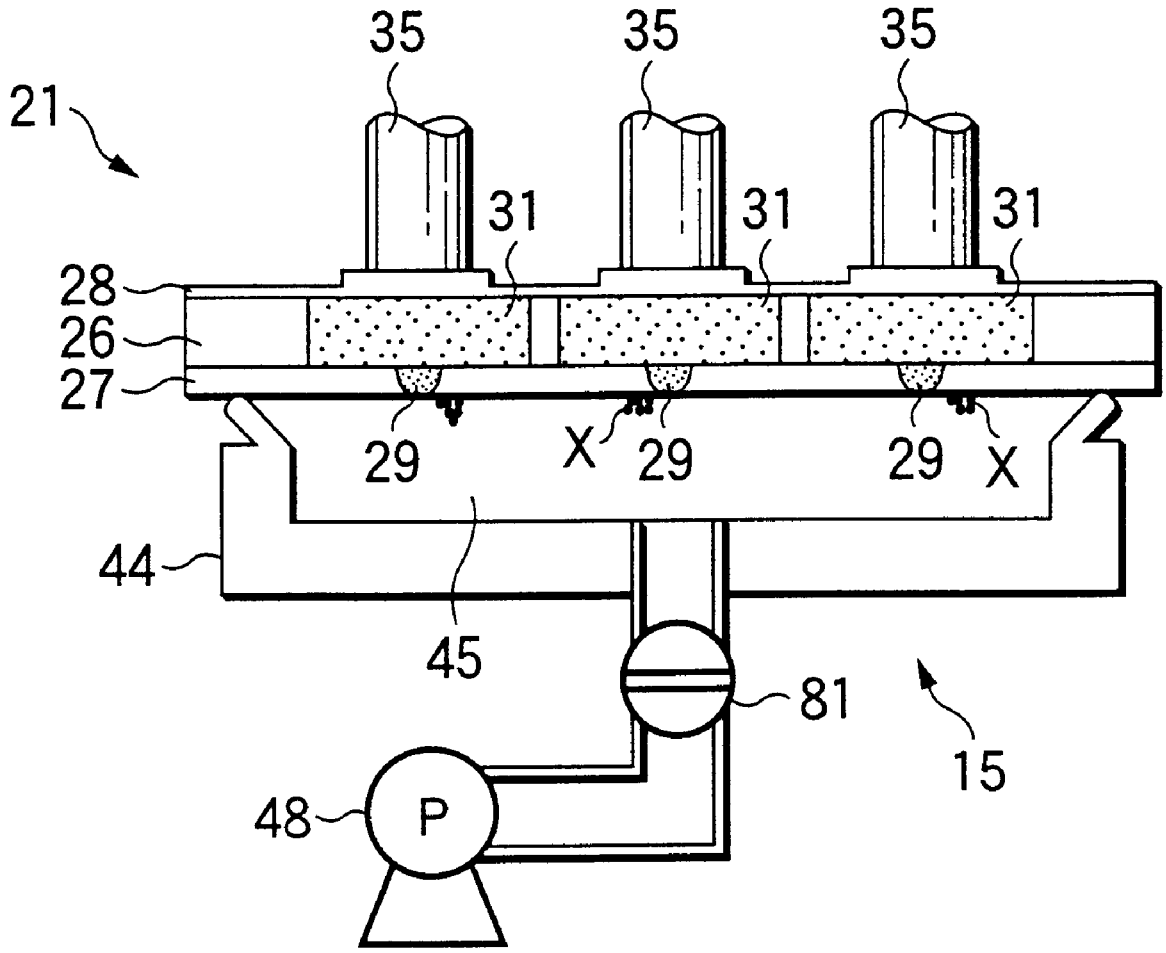
FIG. 9 is a schematic diagram explaining the cleaning operation in accordance with a second embodiment.

In this second embodiment, the capping mechanism 15 differs slightly from that of the above-described first embodiment. Namely, as shown in FIG. 9, this capping mechanism 15 includes a communication control valve 81 disposed midway in the suction passage 46 for allowing the sealed hollow portion 45 and the suction pump 48 to communicate with each other. In addition, another difference lies in that concerning the high-frequency drive signal (corresponding to the second drive signal in accordance with the invention) generated by the drive signal generating circuit 67, the drive voltage of the drive pulse VP is set to a value of such a measure as to be able to eject ink.

It should be noted that the other arrangements are identical to those of the above-described first embodiment, a description thereof will be omitted.

In this second embodiment, when the cleaning mode is set, the nozzle surface 13 of the recording head 10 is first sealed by the cap member 44. Subsequently, the control unit 66 controls the communication control valve 81 and sets it in the closed state. The electric drive system 72 (application controller) of the recording head 10 then applies to the piezoelectric vibrators 35 the high-frequency drive signal from the drive signal generating circuit 67.

Figure 10:
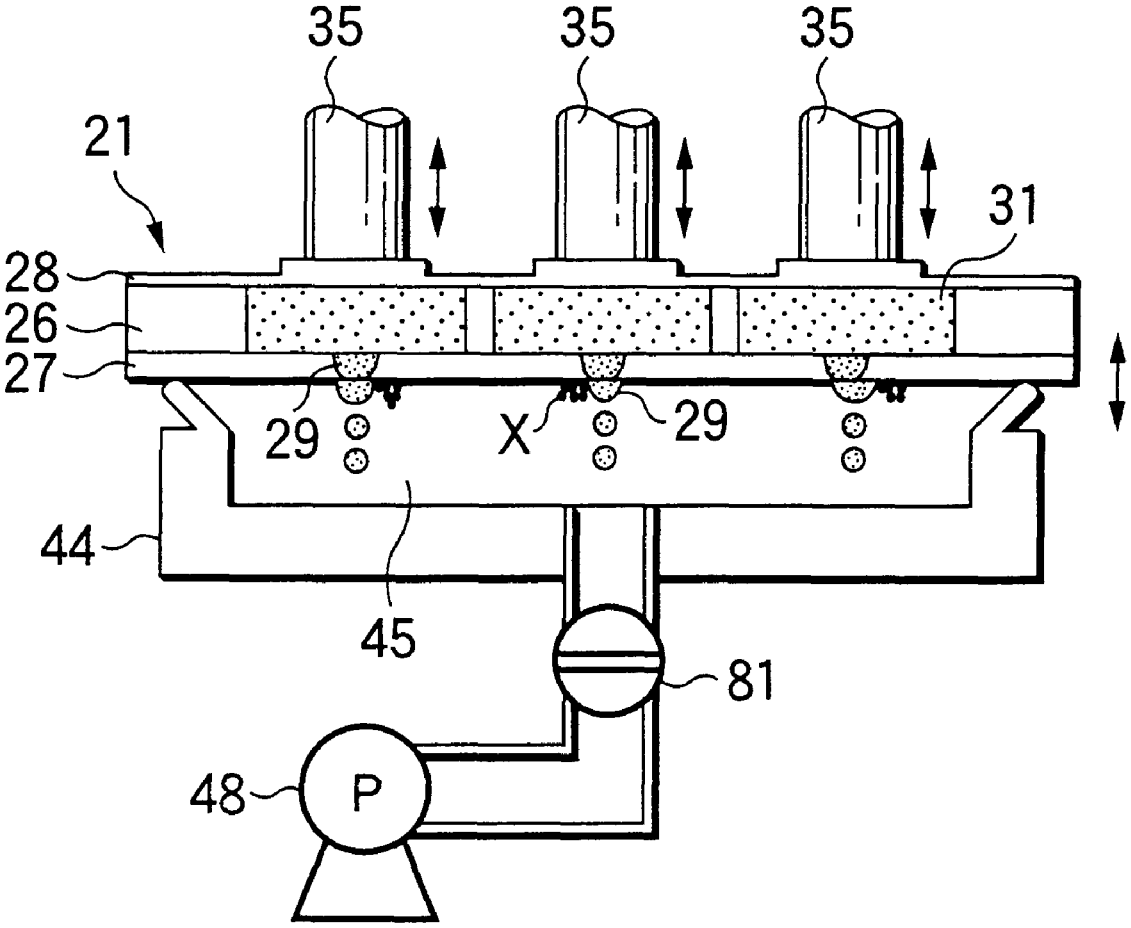
FIG. 10 is a schematic diagram explaining the cleaning operation in accordance with the second embodiment.

By the application of this high-frequency drive signal, the piezoelectric vibrators 35 are vibrated at a high frequency to displace the elastic plate 28, and apply pressure vibrations to the ink solution in the pressure chamber 31. As shown in FIG. 10, the ink solution flows out from the nozzle openings 29 due to the application of the pressure vibrations. The ink solution which thus flowed out is accumulated in the sealed hollow portion 45 of the cap member 44. In addition, in this embodiment, the vibrations from the piezoelectric vibrators 35 are propagated to the nozzle plate 27 as well.

Accordingly, the nozzle plate 27 also vibrates at a high frequency during the period the high-frequency drive signal is being supplied. In this state, the foreign objects X solidified in the vicinities of the nozzle openings 29 are subjected to high-frequency vibration while being wetted by the ink solution which flowed out, and their adhesion is hence weakened in that process.

Figure 11:
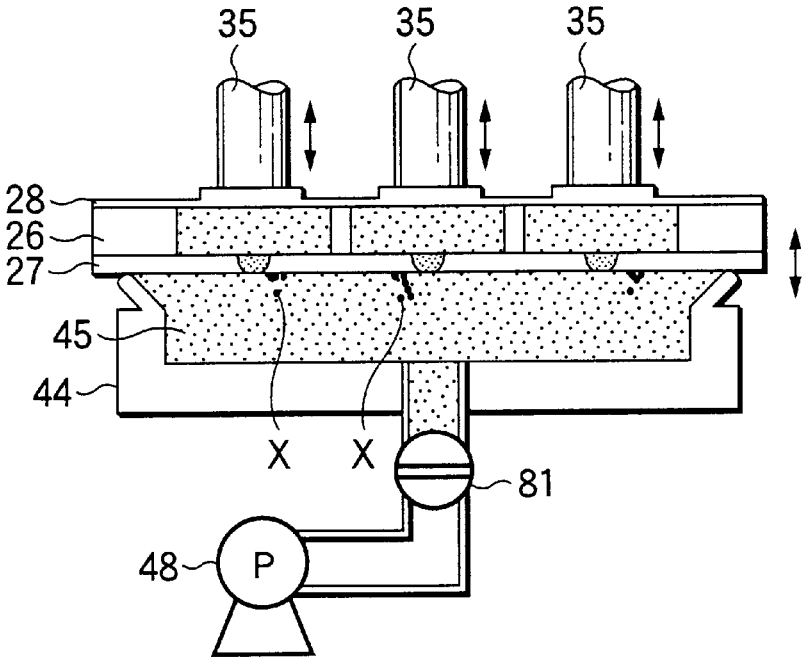
FIG. 11 is a schematic diagram explaining the cleaning operation in accordance with the second embodiment.

When the time elapses further, as shown in FIG. 11, the ink is accumulated in the sealed hollow portion 45 to the extent of immersing the nozzle plate 27. In this state, since the foreign objects X are subjected to the high-frequency vibration in the ink solution, the pressure vibrations act on the foreign objects X through the ink solution as well. Consequently, the force for exfoliating the foreign objects X becomes stronger, so that the foreign objects X can be reliably separated from the nozzle plate 27.

In the series of operation, since the ink solution has flowed out from the nozzle openings 29, the ink solution inside the sealed hollow portion 45 does not flow backward from the nozzle openings 29 to the pressure chamber 31 side. For this reason, the foreign objects X can be discharged reliably. In addition, since the ink solution flows out of the nozzle openings 29, an ink solution which is approximately at room temperature is supplied into the recording head 10 from the ink cartridge 9. By means of the ink solution thus supplied, it is possible to absorb the heat in the piezoelectric vibrators 35 and the driver circuit, thereby making it possible to control the temperature of the piezoelectric vibrators 35 and the driver circuit within a proper range.

It should be noted that if the ink is accumulated in the cap member 44 to the extent of immersing the nozzle plate 27, it is desirable to discharge the ink solution in the sealed hollow portion 45 by small degrees by opening the communication control valve 81 and actuating the suction pump 48 to such an extent that the accumulated level of the ink solution does not decline. The reason is that the trouble of the ink solution overflowing from the sealed hollow portion 45 can be prevented by doing so.

Figure 12:
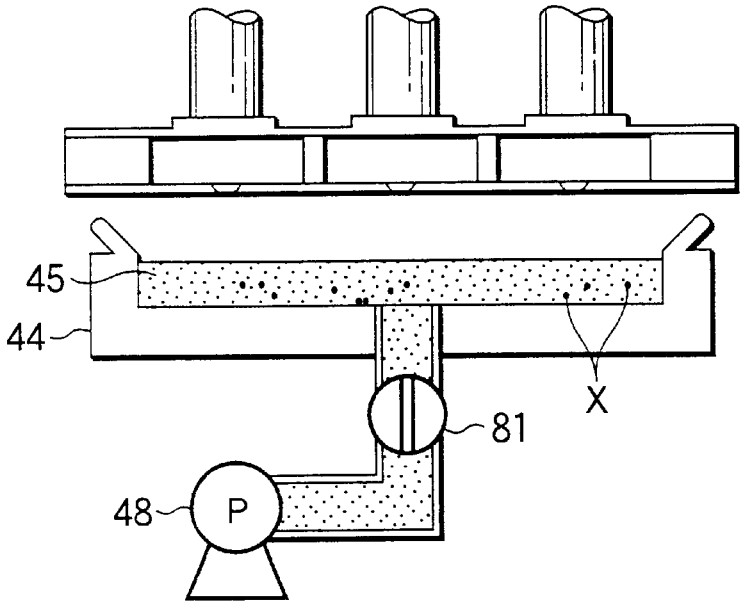
FIG. 12 is a schematic diagram explaining the cleaning operation in accordance with the second embodiment.

If the high-frequency drive signal is supplied to such an extent as to cause the foreign objects X to exfoliate, the suction pump 48 is actuated with the nozzle surface 13 sealed by the cap member 44 so as to suck the ink solution in the recording head 10. Subsequently, as shown in FIG. 12, the cap member 44 is moved away from the nozzle surface 13, and the ink solution in the sealed hollow portion 45 is discharged by opening the communication control valve 81 and by actuating the suction pump 48.

After the discharging of the ink solution, the nozzle surface 13 is wiped by the wiping operation. In this wiping operation, after moving the wiper holder 42 to the upper-limit position, the control unit 66 moves the recording head 10 to the position opposed to the wiper blade 41, and reciprocates the recording head 10 in the main scanning direction. Consequently, even if the foreign objects X remain on the nozzle surface 13, the foreign objects X can be wiped off relatively easily.

Thus, in this embodiment, by vibrating the piezoelectric vibrators 35 at a high frequency, high-frequency vibrations are applied to the foreign objects X while the ink solution is allowed to flow out from the nozzle openings 29. As a result, the foreign objects X can be reliably exfoliated, and the exfoliated foreign objects X can be reliably discharged without flowing backward. Furthermore, since the heat inside the pressure chamber 31 is absorbed by the new ink solution supplied from the ink cartridge 9 side, it is possible to prevent the trouble of the piezoelectric vibrators 35 and the like becoming excessively heated.

Incidentally, although, in the above-described embodiments, the suction of the ink solution from the nozzle openings 29 is effected after the supply of the high-frequency drive signal, the suction of the ink solution from the nozzle openings 29 may be effected while the high-frequency drive signal is being supplied. Hereafter, a description will be given of a third embodiment thus constructed.

Figure 13:
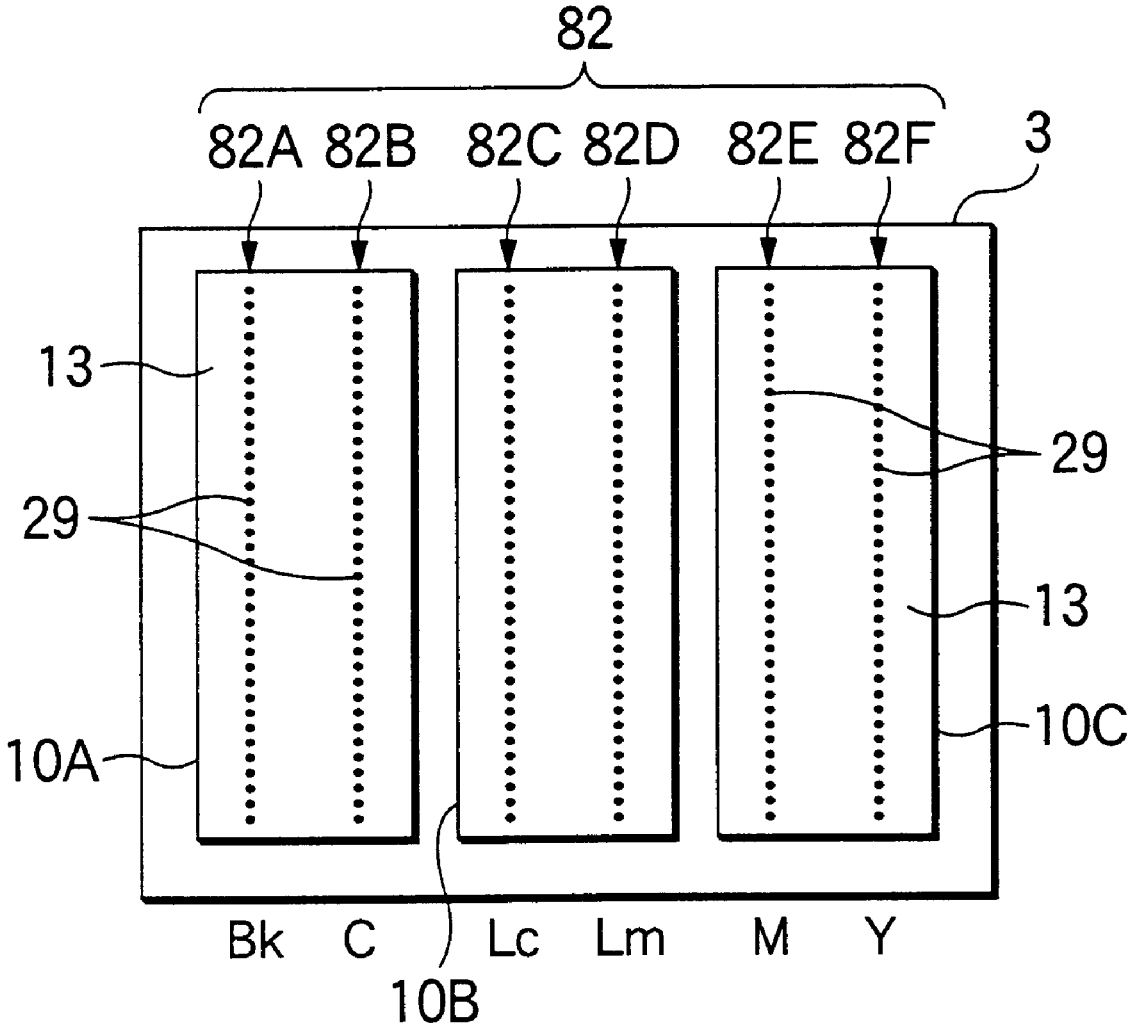
FIG. 13 is a diagram of a recording head, as viewed from the nozzle plate side, in accordance with a third embodiment.

In this embodiment, a plurality of recording heads 10 are mounted. Namely, as shown in FIG. 13, horizontally juxtaposed on the carriage 3 in the main scanning direction are three recording heads 10 including a first recording head 10A positioned on the left-hand side, a second recording head 10B positioned in the center, and a third recording head 10C positioned on the right-hand side. Accordingly, this printer 1 has six nozzle rows 82A (82A to 82F) in total, and is capable of ejecting six kinds of ink solutions at maximum.

In this example, a black ink solution is ejected from one nozzle row 82A of the first recording head 10A, and a cyan ink solution is ejected from the other nozzle row 82B. Similarly, a light cyan ink solution is ejected from one nozzle row 82C of the second recording head 10B, and a light magenta ink solution is ejected from the other nozzle row 82D. Further, a magenta ink solution is ejected from one nozzle row 82E of the third recording head 10C, and a yellow magenta ink solution is ejected from the other nozzle row 82F.

Figure 14A:
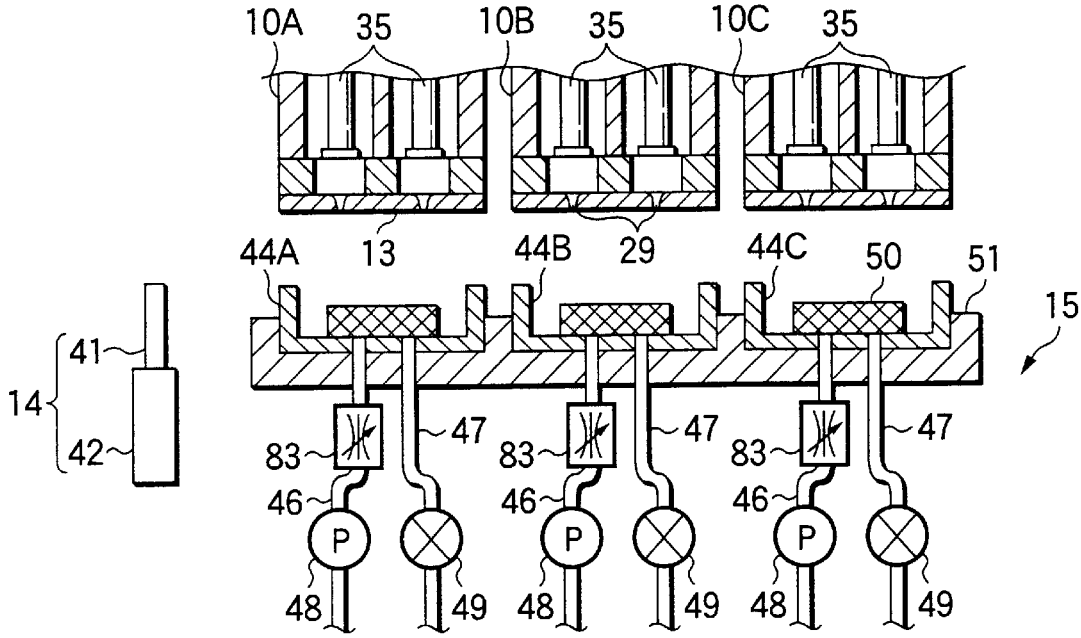
FIGS. 14A and 14B are diagrams explaining the construction of the wiping mechanism and the capping mechanism in accordance with the third embodiment.
Figure 14B:
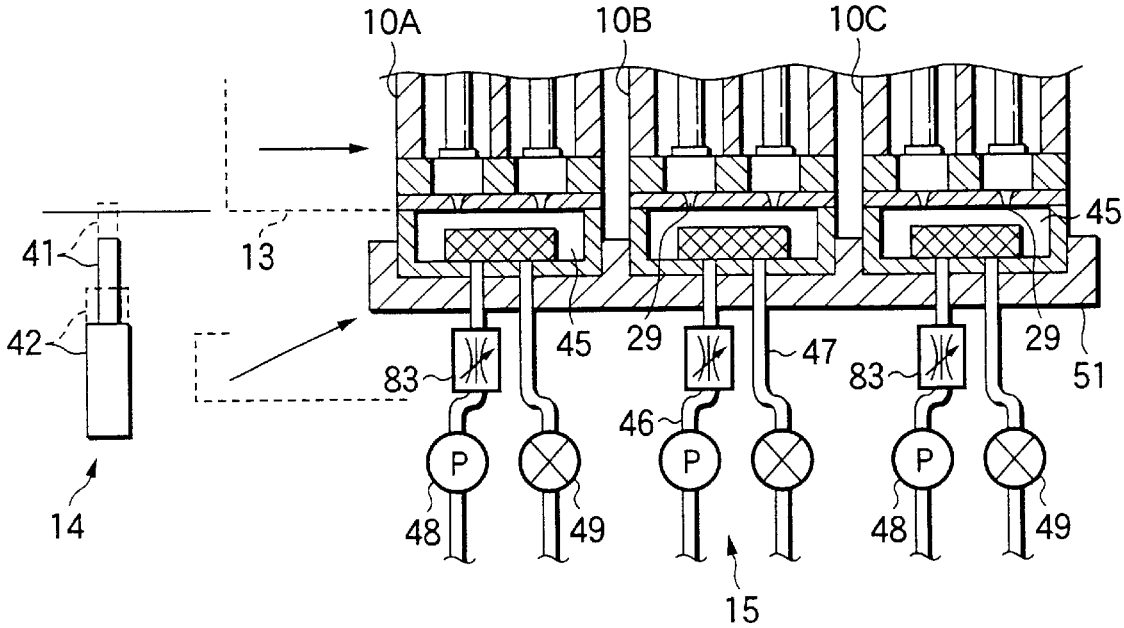
Figure 15:
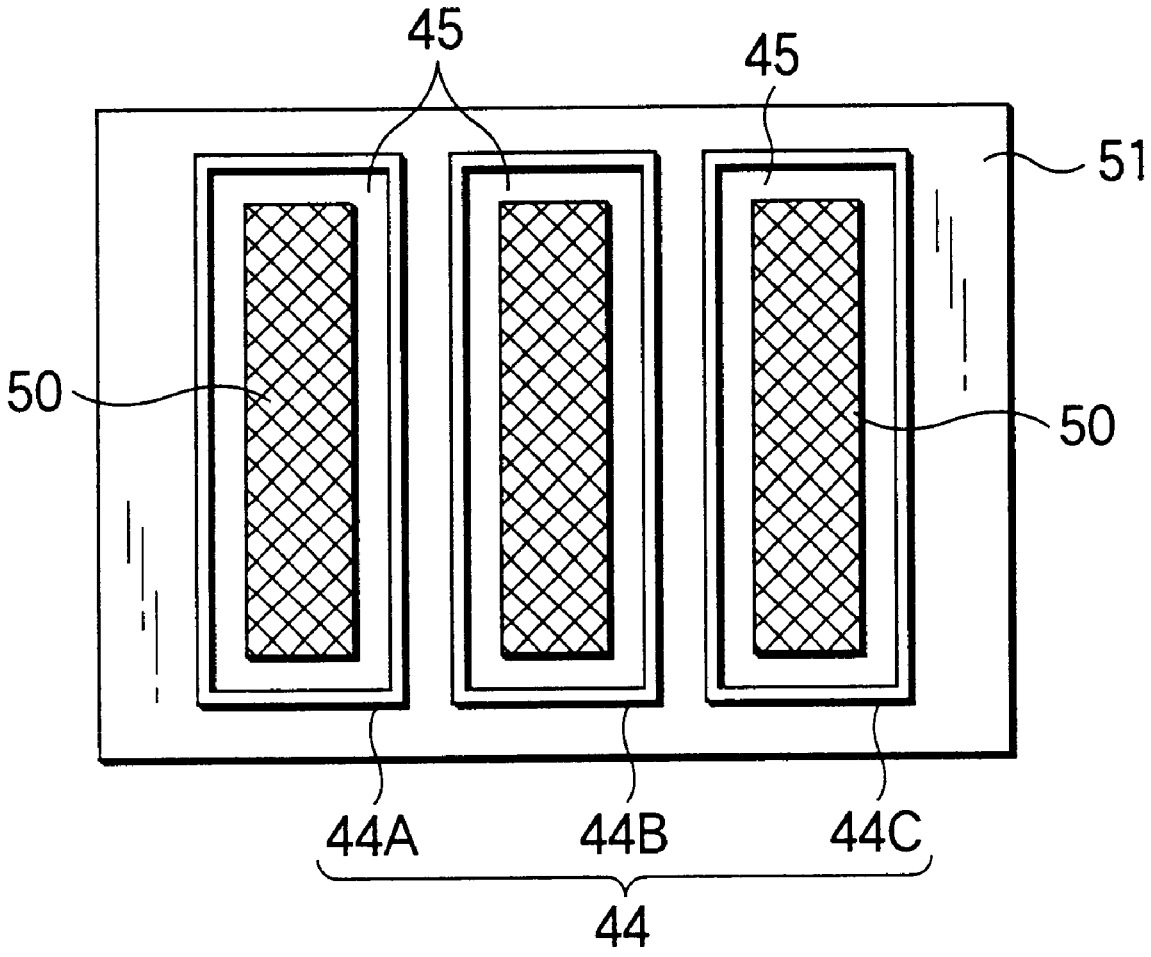
FIG. 15 is a diagrams explaining the construction of the capping mechanism in accordance with the third embodiment.

As shown in FIGS. 14A, 14B, and 15, the capping mechanism 15 in this embodiment comprises: the cup-shaped cap member 44 provided with the sealed hollow portion 45; the suction passage 46 and the open-to-atmosphere passage 47 which communicate with the sealed hollow portion 45 at the bottom of the cap member 44; the suction pump 48 (negatively pressurizing unit) provided midway in the suction passage 46; the opening-closing valve 49 provided midway in the open-to-atmosphere passage 47; a choke valve 83 provided midway in the suction passage 46 on the upstream side of the suction pump 48; the moisture retaining sheet 50 disposed in the sealed hollow portion 45; and the cap lifting mechanism (not shown) for vertically moving the cap member 44.

Among these members, the cap member 44, the suction passage 46, the open-to-atmosphere passage 47, the suction pump 48, the opening-closing valve 49, the moisture retaining sheet 50, and the cap lifting mechanism are constructed in the same way as in the above-described first embodiment. In this embodiment, since three recording heads 10 are provided, these parts are provided in three sets.

In addition, the choke valve 83 functions as the suction-force limiter of the invention, and limits the suction force generated by the suction pump 48 by constricting the channel. This choke valve 83 is a variable choke type, and its amount of constriction can be electrically controlled by the control unit 66 (negative-pressurization controller).

At the home position, as shown in FIG. 14B, the upper surface of the cap member 44 is brought into close contact with the nozzle surface 13 of the recording head 10 to effect sealing. In this sealed state, all the nozzle openings 29 are opposed to the interior of the sealed hollow portion 45. In addition, if the suction pump 48 (negatively pressurizing unit) is actuated with the nozzle surface 13 sealed by the cap member 44, the interior of the sealed hollow portion 45 is set under negative pressure, and the ink solutions in the recording head 10 are sucked out from the nozzle openings 29.

In this embodiment as well, when a condition for transfer to the cleaning mode has become valid, the control unit 66 controls the cleaning operation.

At this time, in this embodiment, in a case where a transfer condition becomes valid with respect to one of the two nozzle rows 82 opposed to one sealed hollow portion 45, the cleaning operation is also effected with respect to the other nozzle row 82. For example, in a case where a condition for transfer to the cleaning mode has become valid only with respect to the yellow nozzle row 82F side, the cleaning operation is effected with respect to the magenta nozzle row 82E opposed to the same cap member 44. Further, the conditions for executing the cleaning operation with respect to both of these nozzle rows 82E and 82F are set to be identical.

The reason for this is to recover as speedily as possible the capacity of ejecting the ink solutions after the cleaning operation. If the cleaning operation is effected only for one nozzle row 82, there is a possibility that bubble, dust, and the like enter the recording head 10 through the nozzle openings of the other nozzle row 82 during this cleaning operation, and should they enter, so that the recovery of the ejection capacity becomes delayed to eliminate these bubbles, dust, and the like.

If the cleaning operation is executed with respect to all the plurality of nozzle rows 82 opposed to the interior of one sealed hollow portion 45 as in this embodiment, the entry of the bubbles, dust, and the like can be prevented, so that the ejection capacity can be recovered speedily.

Figure 16A:
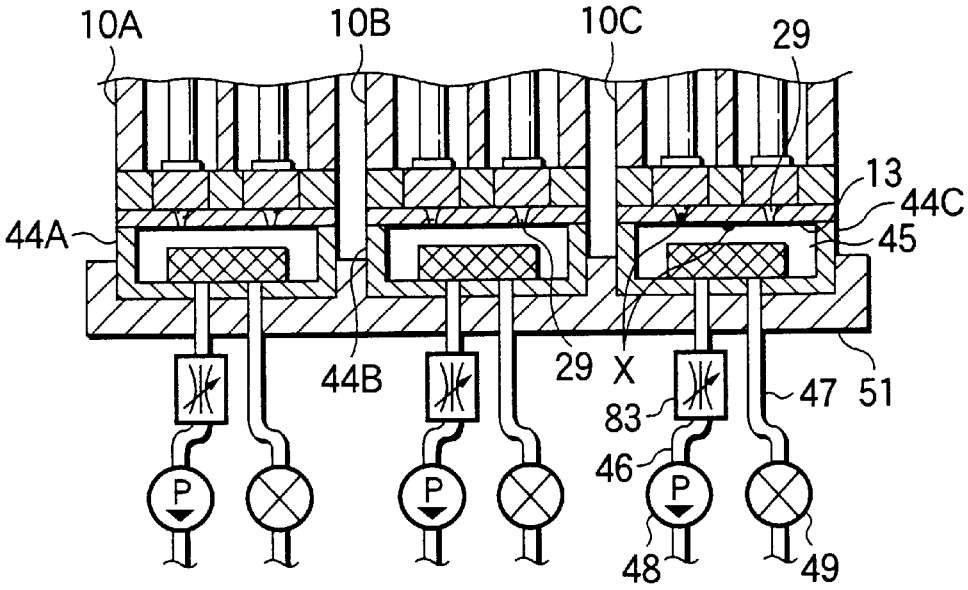
FIGS. 16A and 16B are schematic diagrams explaining the cleaning operation in accordance with the third embodiment.

In the cleaning operation, the control unit 66 first moves the carriage 3 to the home position, and seals the nozzle surface 13 by the cap member 44, as shown in FIG. 16A.

After the sealing of the nozzle surface 13, the ink solutions are supplied into the sealed hollow portion 45 which seals the nozzle rows 82 subject to cleaning. For example, the suction pump 48 of the cap member 44C to which the yellow nozzle row 82F and the magenta nozzle row 82E are opposed is actuated. At this time, the control unit 66, after shutting off the open-to-atmosphere passage 47 by closing the opening-closing valve 49, actuates the suction pump 48. Consequently, the interior of the sealed hollow portion 45 is set under negative pressure, and the ink solutions in the recording head 10 are supplied into the sealed hollow portion 45 through the nozzle openings 29.

At this time, in interlocking relation to the actuation of the suction pump 48, the control unit 66 actuates the choke valve 83 to effect choking, thereby suppressing the suction force generated by the suction pump 48 to a level lower than a normal level. This operation is executed because of the fact that the capping mechanism 15 is also used in the forcible discharging operation of the ink solutions at normal times, and that this cleaning operation is performed for a relatively long period of three minutes, for example.

Namely, if the cleaning operation is effected with the same suction force as in the forcible discharging operation performed at normal times, there are cases where the amounts of ink consumption during the cleaning operation increase depending on the capacity of the suction pump 48. Thus, if the suction force is limited by actuating the choke valve 83 as in this construction, it is possible to suppress the amounts of ink consumption to low levels even if suction is effected over a long period. It should be noted that in a case where the suction pump 48 capable of adjusting the suction force is used, a similar effect can be also obtained by controlling the operation of the suction pump 48.

When the interior of the sealed hollow portion 45 is filled with the ink solution, the control unit 66 controls the drive signal generating circuit 67 to generate the high-frequency drive signal (see FIG. 7) while the suction pump 48 and the choke valve 83 is actuated. Further, the electric drive system 72 (a part of application controller) of the recording head 10 applies to the piezoelectric vibrators 35 the high-frequency drive signal from the drive signal generating circuit 67.

Figure 16B:
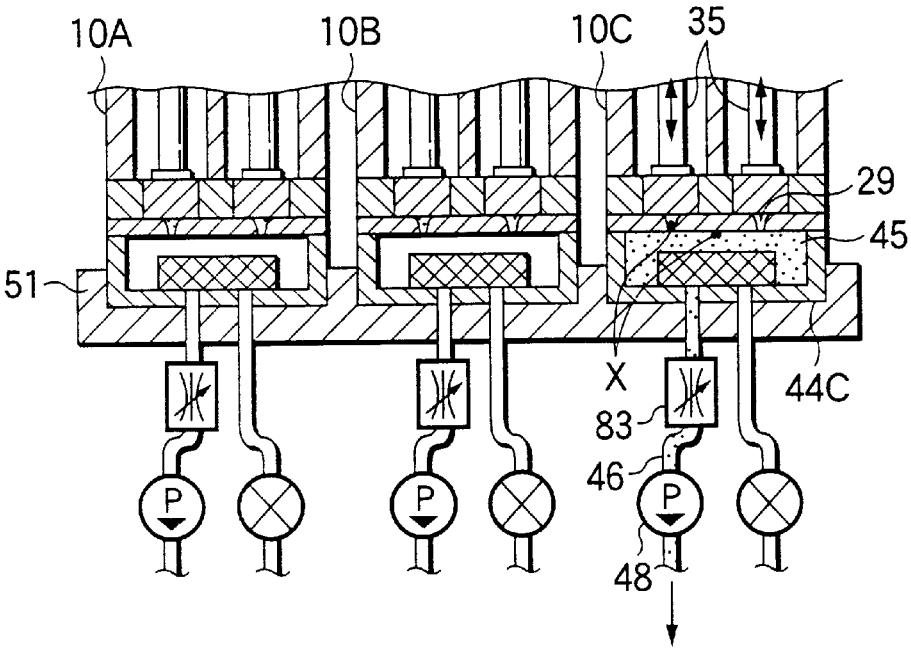

As a result, as shown in FIG. 16B, the piezoelectric vibrators 35 are expanded and contracted in correspondence with the supply of the pulse signal. The vibrations from these piezoelectric vibrators 35 are propagated to the ink solutions in the pressure chamber 31 through the elastic plates 28. Further, the pressure waves and bubbles occurring due to these vibrations are also propagated to the ink solution in the sealed hollow portion 45, and act on the foreign objects X adhering to the interior of the nozzle openings 29 and the nozzle surface 13, thereby weakening the adhesion between the foreign objects X and the recording head 10. Due to these vibrations, the foreign objects X adhering to the recording head 10 are separated from the recording head 10, or their adhesion is weakened.

In addition, the foreign objects X separated from the recording head 10 move toward the sealed hollow portion 45 side by being carried by the flow of the ink solution according to the actuation of the suction pump 48. Similarly, the foreign objects X whose adhesion is weakened are separated from the recording head 10 by the flow of the ink solution, and is moved toward the sealed hollow portion 45 side. For this reason, the foreign objects X separated from the recording head 10 can be reliably discharged without flowing backward into the nozzle openings 29 and the pressure chambers 31.

Since the application of the high-frequency vibrations is effected while the ink solutions in the recording head 10 are sucked, it is also possible to prevent the entry of bubbles into the recording head 10 and the entry of foreign objects such as paper dust and other dust into the sealed hollow portion 45.

In addition, since the driving source of vibrations is the piezoelectric vibrators 35 used for ejecting the ink solutions, it is unnecessary to provide an exclusive-use driving source, so that it is possible to attain simplification of the configuration of the apparatus. Further, it is possible to apply large vibrational energy to the ink solutions.

It should be noted that the invention is not limited to the above-described embodiments, and various modifications are possible within the scope of the invention as stated in the claims.

For example, although, in the above-described embodiments, the high-frequency drive signal is applied to the piezoelectric vibrators 35 with the nozzle surface 13 sealed by the cap member 44, the invention is not limited to this arrangement. Namely, the cap member 44 may be disposed at a position spaced apart from the nozzle surface 13 with the sealed hollow portion 45 opposed to the nozzle surface 13, and the high-frequency drive signal from the drive signal generating circuit 67 may be applied to the piezoelectric vibrators 35 in this spaced-apart state.

In this case, if the drive voltage of the drive pulse VP is set to such a value as to allow the ink solution to be ejected, the ink solution ejected into the sealed hollow portion 45 is accumulated; then, this ink solution is discharged by actuating the suction pump 48. Then, if the high-frequency vibrations is sufficiently applied, the nozzle surface 13 is sealed by the cap member 44, and the suction pump 48 is actuated in this sealed state. As a result, it is possible to discharge the exfoliated foreign objects X outside the recording head 10.

Figure 17:
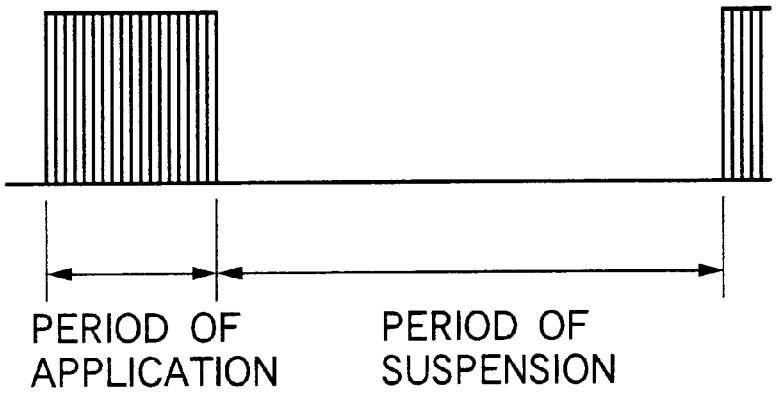
FIG. 17 is a diagram explaining a pattern of application of a high-frequency drive signal.

In addition, in the above-described embodiments, an arrangement may be provided such that the high-frequency drive signal is intermittently applied to the piezoelectric vibrators 35 a plurality of times. For example, as shown in FIG. 17, the process in which the high-frequency drive signal is applied continuously for a 0.25 second and the application is subsequently suspended for a 0.75 second is set as one cycle, and the control unit 66 and the electric drive system 72 (i.e., application controller) of the recording head 10 performs this cycle repeatedly.

The reason for intermittently applying the high-frequency drive signal in this manner is to allow the pulsation of the ink solution to act on the foreign objects X in addition to the vibrations from the piezoelectric vibrators 35 during the cleaning operation. For instance, a sudden pressure change immediately after the changeover from the suspension period to the application period can act on the foreign objects X. For this reason, the exfoliation of the foreign objects X can be promoted further. In addition, if the high-frequency drive signal is applied intermittently, it is possible to suppress the heat generation in the piezoelectric vibrators 35, and prevent an increase of the capacity of the power source.

It should be noted that the application period and the suspension period are not limited to this example, and may be set arbitrarily. For example, the cycle may be repeatedly performed in which the high-frequency drive signal of 100 kHz is supplied for 5 seconds (500,000 vibrations), and the application is subsequently suspended for 5 seconds.

In addition, the piezoelectric vibrators 35 to which the high-frequency drive signal is applied may be made selectable by the control unit 66 and the electric drive system 72 (i.e., application controller) of the recording head 10.

Figure 18:
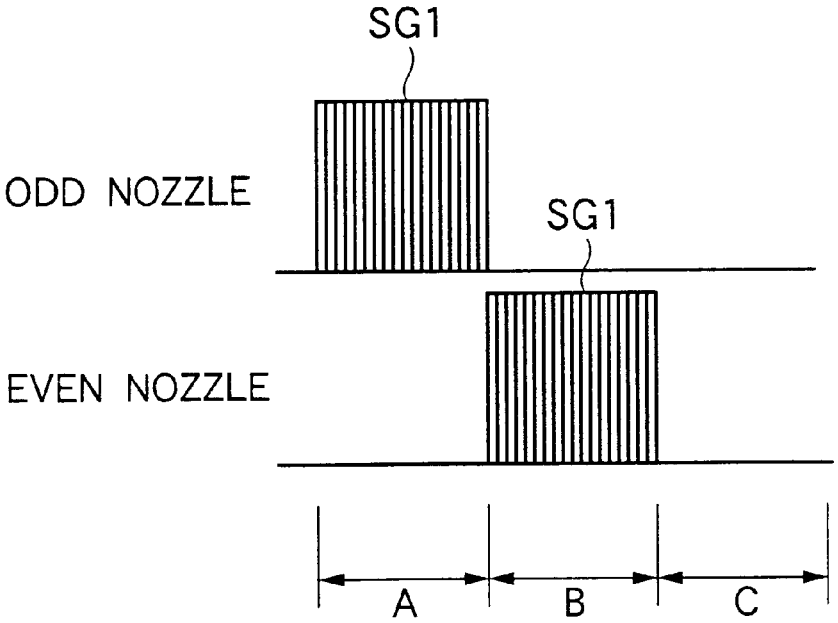
FIG. 18 is a diagram explaining a pattern of application of the high-frequency drive signal.

For example, as shown in FIG. 18, the high-frequency drive signal may be applied alternately to odd nozzles and even nozzles. Namely, in this example, the high-frequency drive signal is applied to odd nozzles for the first one minute (period A), the high-frequency drive signal is applied to even nozzles for the next one minute (period B), and for the final one minute (period C) the application of the high-frequency drive signal is stopped and only the suction of the ink solution is effected. Then, after the suction of the ink solution for the period C is completed, the ink solution in the sealed hollow portion 45 is discharged, and the wiping of the nozzle surface 13 is performed.

By virtue of the above-described arrangement, it is possible to suppress the heat generation in the piezoelectric vibrators 35 while securing high-frequency vibrational energy necessary and sufficient for the exfoliation of the foreign objects X. Namely, although the high-frequency vibrations are applied for a total of two minutes, the period of vibration of the respective piezoelectric vibrators 35 can be one half of it, i.e., one minute. Thus, since the operating time of the piezoelectric vibrators 35 can be short, the burden is alleviated, and the heat generation in the piezoelectric vibrators 35 can be suppressed. In addition, the number of piezoelectric vibrators 35 per nozzle row 82 is identical to the number of nozzle openings 29 (e.g., 96), and is sufficiently large. For this reason, even if the piezoelectric vibrators 35 for effecting the high-frequency vibration are half, it is possible to obtain vibrational energy necessary and sufficient for the exfoliation of the foreign objects X.

In addition, since the above-described recording head 10 is normally capable of color recording, the recording head 10 has a plurality of nozzle blocks each having a common ink-solution supply source. The nozzle row, for instance, corresponds to this nozzle block. Meanwhile, in a case where one nozzle row is capable of ejecting ink solutions of a plurality of colors, and in a case where, for example, a yellow block capable of ejecting a yellow ink solution, a magenta block capable of ejecting a magenta ink solution, and a cyan block capable of ejecting a cyan ink solution are provided, the yellow block, the magenta block, and the cyan block correspond to such nozzle blocks.

The supply of the high-frequency drive signal may be controlled by the control unit 66 and the electric drive system 72 (i.e., application controller) of the recording head 10 for each unit of the pressure generating elements 35 belonging to the nozzle block. In this case, the capping mechanism 15 and the control unit 66 (i.e., suction unit) are preferably arranged to be capable of sucking the solution for each nozzle block.

According to such an arrangement, it is possible to control the application of high-frequency vibrations for each ink-solution supply source, and suction control can be also effected for each ink solution. For this reason, this arrangement is effective in a case where the degree of precipitation of the pigment and the like differ for each ink solution. That is, as for the ink solution for which thickening and solidification are difficult to occur, unnecessary cleaning operation is not performed, so that wasteful consumption of the ink solution can be suppressed.

In addition, at least one of the generation period and the drive voltage of the drive pulse VP which the high-frequency drive signal has maybe varied by the drive signal generating circuit 67.

Figure 19:
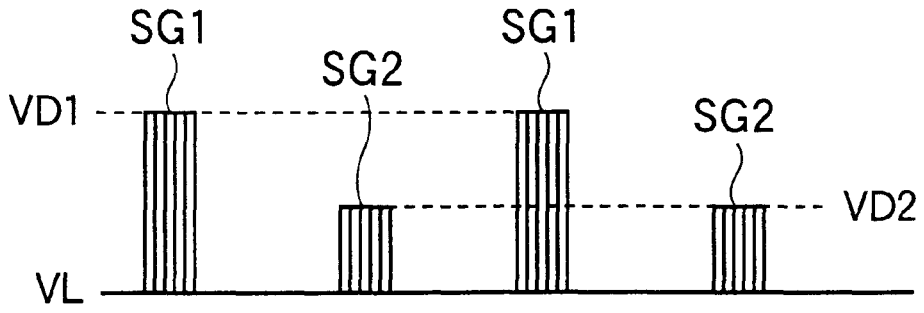
FIG. 19 is a diagram explaining a pattern of application of the high-frequency drive signal.

For example, as shown in FIG. 19, the high-frequency drive signal may include first pulse signal groups SG1 in which the potential is varied in a range between the drive potential VD and the minimum potential VL and second pulse signal groups SG2 in which the potential is varied in a range between a second drive potential VD2 lower than the drive potential VD and the minimum potential VL. The first pulse signal groups SG1 and the second pulse signal groups SG2 may be generated alternately.

Figure 20:
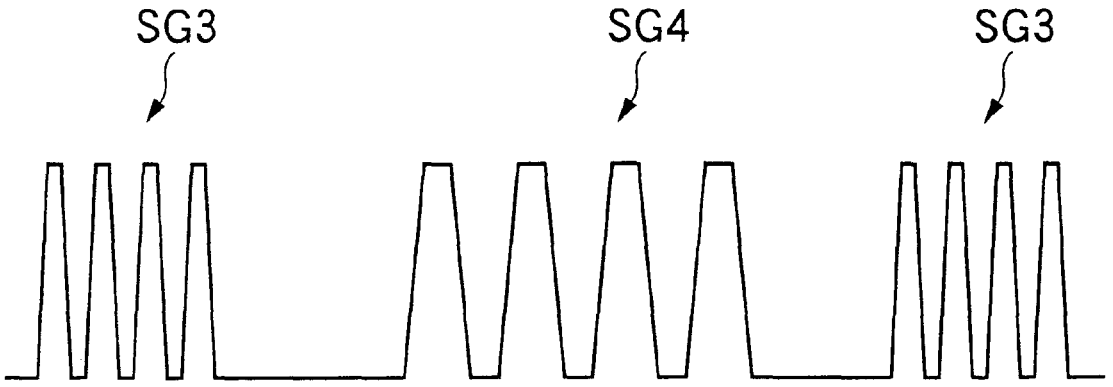
FIG. 20 is a diagram explaining a pattern of application of the high-frequency drive signal.

In addition, the frequency of the high-frequency drive signal may be varied. For example, as shown in FIG. 20, the high-frequency drive signal may include third pulse signal groups SG3 with a standard frequency (e.g., 100 kHz) and fourth pulse signal groups SG4 with a low frequency (e.g., 80 kHz) lower than the standard frequency. The third pulse signal groups SG3 and the fourth pulse signal groups SG4 may be generated alternately.

As mentioned above, if the period or the amplitude of the high-frequency drive signal is thus varied, the pulsation of the ink solution can be made to effectively act on the foreign objects X, so that the separation of the foreign objects can be reliably promoted. Incidentally, both of the period and the amplitude of the high-frequency drive signal may be varied.

In the present invention, a vibration applying element capable of applying vibration to ink solution inside the pressure chamber 31 may be provided to the recording head 10.

Figure 21A:
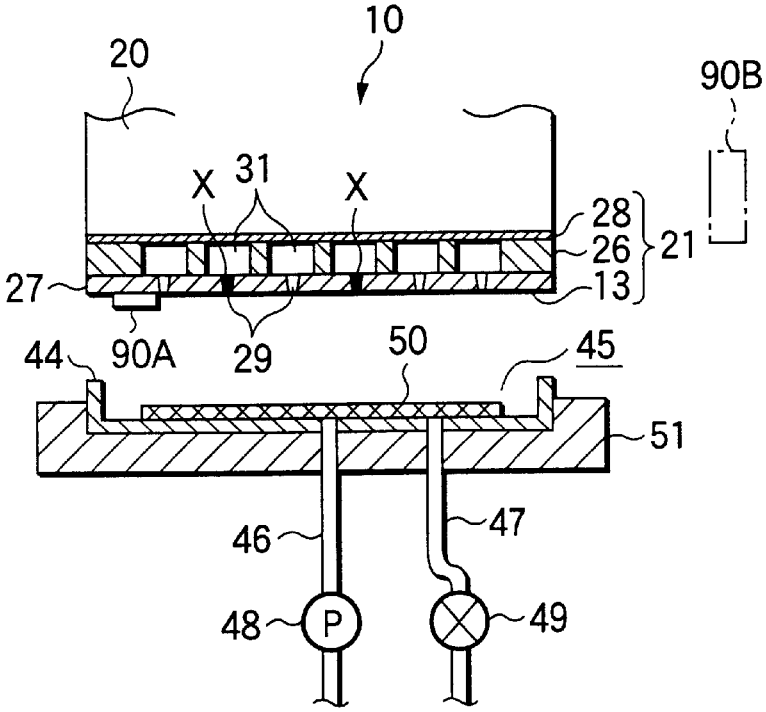
FIGS. 21A and 21B are diagrams explaining a modification to which a vibration applying element is employed.
Figure 21B:
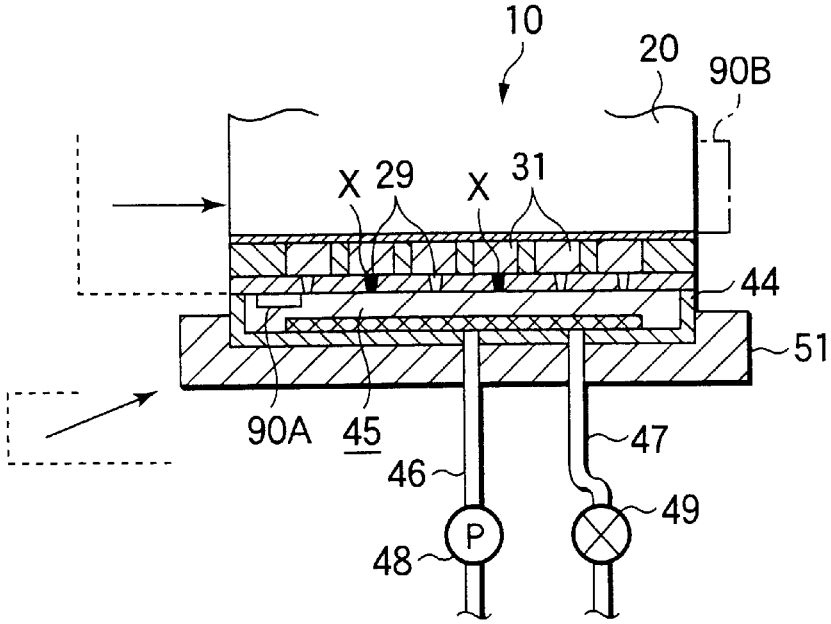

For example, as shown in FIGS. 21A and 21B, a piezoelectric vibrator 90A as a kind of the above-mentioned vibration applying element 90 (see FIG. 22) is provided to the channel unit 21 of the recording head 10. The piezoelectric vibrator 90A vibrates in a period corresponding to an applied driving signal and applies the vibration to ink solution inside the recording head 10.

The providing position of the piezoelectric vibrator 90A is not especially limited as long as it can apply the vibration to the ink solution, preferably, may be provided to the nozzle surface 13 as shown in FIG. 21, since the vibration can be certainly applied to the ink solution at the vicinity to the nozzle openings 29 where the ink solution is sensitive.

When the piezoelectric vibrator 90A is provided to the nozzle surface 13, the vibration can be efficiency applied to the ink solution accumulated in the pressure chamber 31 by bimetal effect between the nozzle plate 27 and the piezoelectric vibrator 90A.

Figure 22:
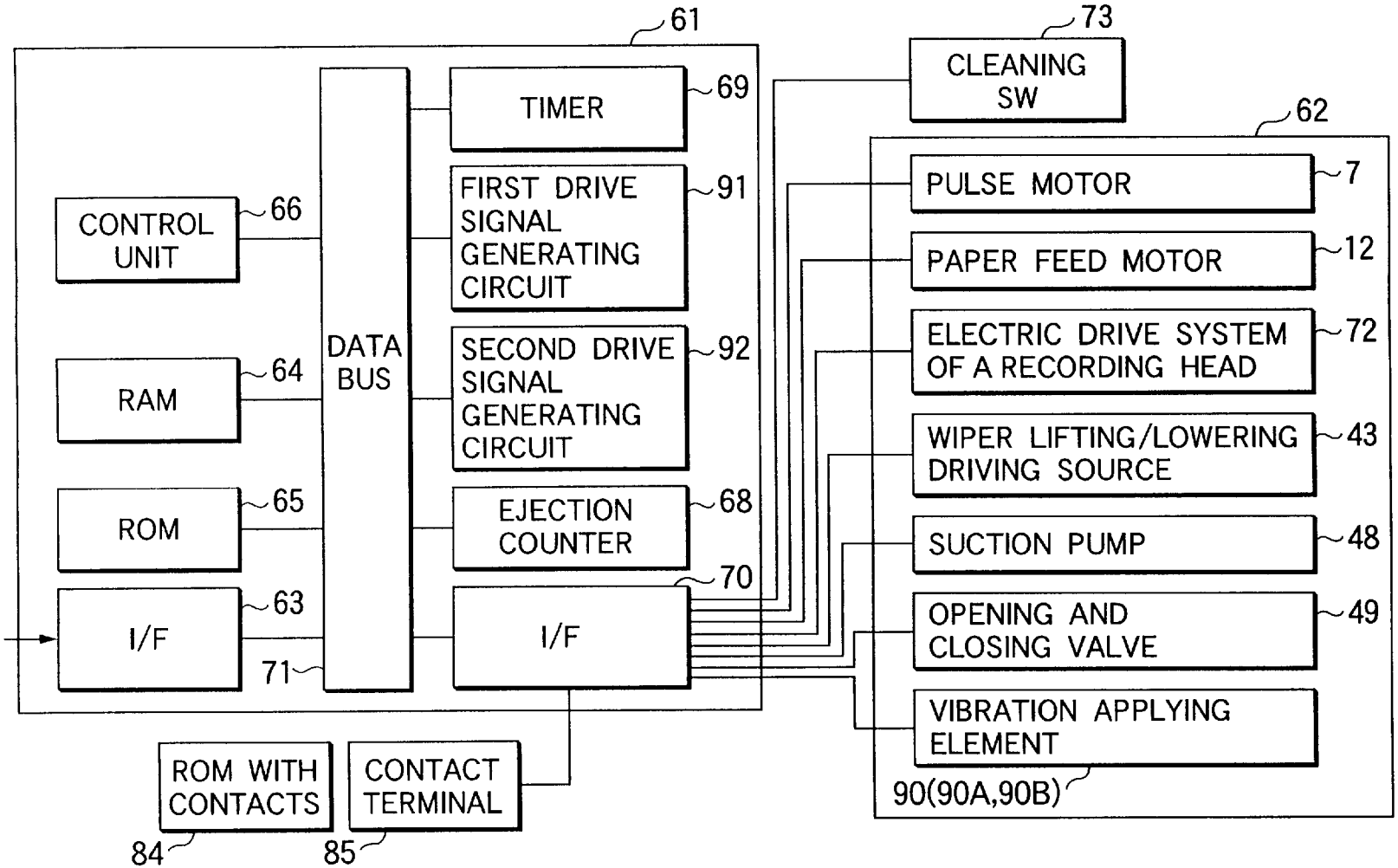
FIG. 22 is a block diagram explaining the electrical configuration of a modification to which the vibration applying element is employed.

A high frequency drive signal from a second drive signal generating circuit 92 (corresponds to a second drive signal generator of the present invention) as shown in FIG. 22 is applied to the piezoelectric vibrator 90A. The high frequency drive signal is a kind of a second drive signal of the present invention, and set so that a generation period of the drive pulse thereof is higher than that of the ejection drive signal generated by the first drive signal generating circuit 91.

In this modification, the controller unit 66 functions as a application controller of the present invention, and controls an application of the high frequency drive signal to the piezoelectric vibrator 90A. For example, in the time of the cleaning operation, the controller unit instructs the second drive signal generating circuit 92 to apply the high frequency drive signal to the piezoelectric vibrator 90A. Therefore, as in the above embodiments, the vibration from the piezoelectric vibrator 90A acts on the ink solution inside the pressure chamber 31, and weakens the adhesion of foreign objects X adhering to the interior of the nozzle openings 29 and the nozzle surface 13 is weakened, or these foreign objects X are separated.

The ink solution inside the recording head 10 is sucked in associating with an application of the high frequency drive signal to the piezoelectric vibrator 90A (for example, during the period of application). That is, the sucking pump 48 is actuated in a state that the nozzle surface 13 is in close contact with the cap member 44. Thereby, the foreign objects X which is separated or whose adhesion if weakened by the application of the vibration can be certainly removed by discharging it to an exterior of the recording head.

In this modification, the same effect as in the above embodiments can be obtained by controlling the operation of the sucking pump 48 and/or adjusting the wave shapes of the high frequency drive signal.

The first and second drive signal generating circuits 91 and 92 may be formed separately from each other as shown in FIG. 22, but these may be constituted so as to form a single drive signal generating circuit.

The vibration applying element 90 is not limited to a piezoelectric vibrator 90A, and is may provided so as to be able to abut against the recording head 10.

As indicated by a dotted line shown in FIG. 21, a ultrasonic vibrator 90B is employed as the vibration applying element 90, and is able to abut against the surface of the recording head in the waiting position of the recording head 10. In this construction, the ultrasonic vibrator 90B is provided in the home position so as to abut against the recording head when the recording head 10 is moved to the waiting position.

When the high frequency drive signal is applied to the ultrasonic vibrator 90B in the abutment state, the ultrasonic vibrator 90B vibrates in a frequency according to the high frequency drive signal. The vibration from the ultrasonic vibrator 90B is propagated inside of the recording head 10 from the abutment portion, and acts on the ink solution inside the recording head 10. Therefore, in this configuration, exfoliating of the foreign objects X is accelerated by the vibration from the ultrasonic vibrator 90B, thereby removing the foreign objects X efficiency.

As shown in FIG. 5, the ink cartridge 9 may be provided with a ROM with contacts 84. Various information concerning inks such as ink type information is stored in this ROM with contacts 84. As a result, the ROM with contacts 84 can function as an ink-type information storage unit.

The ROM with contacts 84 is electrically connected to the printer controller 61 through contact terminals 85 provided on the carriage 3. Consequently, the printer controller 61 is able to read out the information stored in the ROM with contacts 84 and recognize the type of ink solution being used, so that a reference value for judgment corresponding to this ink-type information can be set.

In this arrangement, it is possible to automatically set optimum reference values for judgment with respect to a plurality of kinds of ink solution. For example, even if the ink solution is changed from a pigment-based ink solution to a dye-based ink solution, an optimum reference value for judgment is automatically set. In consequence, an optimum reference value for judgment is set even if the user does not effect special setting operation, so that ease of use can be improved.

The piezoelectric vibrators of the invention are not limited to the piezoelectric vibrators 35, and it is possible to use electro mechanical transducers such as electrostatic actuators, magnetostrictive elements, and so forth.

Furthermore, the invention is applicable to liquid ejecting apparatuses other than the printer 1 where the ejection head capable of ejecting solution from the nozzle opening is provided. For example the invention is applicable to filter manufacturing apparatuses, liquid-crystal injecting apparatuses, and the like.

As described above, in accordance with the invention the following advantages are offered.

Namely, since the arrangement provided is such that the drive signal generating unit is capable of generating a first drive signal which is used when the liquid is ejected toward an object of ejection and a second drive signal whose frequency at which the drive pulse is generated is higher than the first drive signal, and the suction unit is actuated in association with the application of the second drive signal to the pressure generating element, it is possible to effectively eliminate the thickened liquid and solidified liquid and other foreign objects in the vicinities of the nozzle openings. In addition, since the source of vibration is the piezoelectric vibrator, an exclusive-use source of vibration is unnecessary, and the simplification of the configuration of the apparatus can be attained.

In the configuration that the second drive signal is applied to the pressure generating element, since the source of vibration is the pressure generating element, an exclusive-use source of vibration is unnecessary. Therefore, the simplification of the configuration of the apparatus can be attained.

In a case where the suction unit is actuated during the period of the second drive signal being applied to the pressure generating element, the foreign objects exfoliated by the application of the second drive signal to the pressure generating element can be reliably removed without returning them to the interior of the ejection head.

In a case where the second drive signal is applied to the pressure generating element in a state that the liquid is accumulated in the sealed hollow portion, the vibrations are propagated to the liquid in the sealed hollow portion, so that the foreign objects can be removed effectively.

In a case where the liquid is accumulated in the sealed hollow portion by actuating the negatively pressurizing unit in a state that the nozzle surface is sealed by the cap member, the supply unit for supplying the liquid into the sealed hollow portion can be constituted by the suction unit, thereby making it possible to simplify the apparatus.

In a case where the second drive signal is intermittently applied to the pressure generating element a plurality of times, it is possible to suppress the electric power for driving the pressure generating element to a low level. In addition, since the pulsation occurring due to the intermittent application can be made to act on the foreign objects, the foreign objects can be effectively removed.

In a case where pressure generating elements to which the second drive signal is applied are arranged to be selectable, it is possible to suppress the electric power for driving the pressure generating elements to a low level.

In a case where the suction-force limiter is arranged to be actuatable in interlocking relation to the actuation of the suction unit, it is possible to optimize the amount of liquid sucked from the ejection head.

What is claimed is:

1. A liquid ejecting apparatus comprising:

an ejection head including a nozzle opening capable of ejecting a liquid, a pressure generating chamber communicating to the nozzle opening, and a pressure generating element for changing a pressure in the liquid inside the pressure generating chamber;

a drive signal generator for generating a drive signal including a drive pulse to be applied to the pressure generating element;

an application controller for controlling an application of the drive signal to the pressure generating element; and a suction unit for sucking the liquid in the ejection head through the nozzle opening, wherein the drive signal generator is capable of generating a first drive signal which is used when the liquid is ejected toward an object of ejection and a second drive signal which is used at a time of the cleaning operation of the ejection head and whose frequency at which a drive pulse is generated is higher than that of the first drive signal, wherein the cleaning operation includes accumulating the liquid in the suction unit and bringing a nozzle surface side of the ejection head into contact with the liquid in the suction unit, and wherein the suction unit is actuated in association with an application of the second drive signal to the pressure generating element.

2. The liquid ejecting apparatus according to claim 1, wherein the suction unit includes a cap member having a sealed hollow portion which is open to the nozzle surface side of the ejection head, a negatively pressurizing unit communicating to the cap member to negatively pressurize the sealed hollow portion, and a negative-pressurization controller for controlling an actuation of the negatively pressurizing unit, and the nozzle surface is sealed with the nozzle opening opposed to an interior of the sealed hollow portion, and the negatively pressurizing unit is actuated in the sealed state to suck the liquid inside the ejection head.

3. The liquid ejecting apparatus according to claim 2, wherein the cap member is capable of being disposed at a position spaced apart from the nozzle surface in a state that the sealed hollow portion is opposed to the nozzle surface, and the application controller applies the second drive signal to the pressure generating element in the spaced-apart state.

4. The liquid ejecting apparatus according to claim 2, wherein the application controller applies the second drive signal to the pressure generating element in a state that the nozzle surface is sealed by the cap member.

5. The liquid ejecting apparatus according to claim 4, wherein the application controller applies the second drive signal to the pressure generating element in a state that the liquid is accumulated in the sealed hollow portion.

6. The liquid ejecting apparatus according to claim 5, wherein the liquid is accumulated in the sealed hollow portion by actuating the negatively pressurizing unit in a state that the nozzle surface is sealed by the cap member.

7. The liquid ejecting apparatus according to claim 6, wherein the liquid accumulated in the sealed hollow portion and the nozzle surface are brought into contact with each other in the state that the nozzle surface is sealed by the cap member.

8. The liquid ejecting apparatus according to claim 4, wherein an opening-closing valve whose opening and closing are controlled by the negative-pressurization controller is provided midway in an open-to-atmosphere passage having one end communicating to the sealed hollow portion of the cap member and another end open to the atmosphere, and the negative-pressurization controller closes the opening-closing valve in the state that the nozzle surface is sealed by the cap member, and the negative-pressurization controller opens the opening-closing valve and actuates the negatively pressurizing unit when the sealing of the nozzle surface is released.

9. The liquid ejecting apparatus according to claim 1, wherein the suction unit is actuated after application of the second drive signal to the pressure generating element.

10. The liquid ejecting apparatus according to claim 1, wherein the suction unit is actuated during the second drive signal is applied to the pressure generating element.

11. The liquid ejecting apparatus according to claim 1, wherein the application controller intermittently applies the second drive signal to the pressure generating element a plurality of times.

12. The liquid ejecting apparatus according to claim 1, further comprising at least one additional pressure generating element, wherein the application controller is capable of selecting pressure generating elements to which the second drive signal is applied.

13. The liquid ejecting apparatus according to claim 12, wherein the ejection head has a plurality of nozzle blocks each having a common liquid supply source, and the application controller applies the second drive signal to each unit of the pressure generating elements belonging to the nozzle block.

14. The liquid ejecting apparatus according to clam 13, wherein the suction unit is capable of sucking the liquid for each nozzle block.

15. The liquid ejecting apparatus according to clam 12, wherein the ejection head has a plurality of nozzle rows each having nozzle openings formed in a row, and the application controller applies the second drive signal alternately to odd-numbered nozzle openings and even-numbered nozzle openings which belong to one nozzle row.

16. The liquid ejecting apparatus according to claim 1, wherein the application controller periodically effects application of the second drive signal and suction by the suction unit.

17. The liquid ejecting apparatus according to claim 1, wherein the application controller applies the second drive signal on condition that the application controller receives an instruction signal for instructing the supply of the second drive signal.

18. The liquid ejecting apparatus according to claim 1, wherein a suction-force limiter is provided for limiting the suction force of the suction unit, and the suction-force limiter is arranged to be capable of being actuated in interlocking relation to the actuation of the suction unit.

19. The liquid ejecting apparatus according to claim 1, wherein a wiping mechanism for wiping the nozzle surface is provided.

20. The liquid ejecting apparatus according to claim 1, wherein at least one of a generation period and a drive voltage of the drive pulse is capable to be varied.

21. The liquid ejecting apparatus according to claim 1, wherein the frequency at which the drive pulse is generated in the second drive signal is set to not less than 30 kHz and not more than 200 kHz.

22. The liquid ejecting apparatus according to claim 1, wherein the frequency at which the drive pulse is generated in the second drive signal is set to not less than 80 kHz and not more than 120 kHz.

23. The liquid ejecting apparatus according to claim 1, wherein a drive voltage of the drive pulse which the second drive signal has is set to a voltage value at which the liquid is not ejected.

24. The liquid ejecting apparatus according to claim 1, wherein a drive voltage of the drive pulse which the second drive signal has is set to a voltage value at which the liquid is ejected.

25. The liquid ejecting apparatus according to claim 1, wherein the pressure generating element is a piezoelectric vibrator.

26. A liquid ejecting apparatus comprising:

an ejection head including a nozzle opening capable of ejecting a liquid, a pressure generating chamber communicating to the nozzle opening, and a pressure generating element for changing a pressure in the liquid inside the pressure generating chamber;

a drive signal generator for generating a drive signal including a drive pulse to be applied to the pressure generating element;

an application controller for controlling an application of the drive signal to the pressure generating element; and a suction unit for sucking the liquid in the ejection head through the nozzle opening, wherein the drive signal generator is capable of generating a first drive signal which is used when the liquid is ejected toward an object of ejection and a second drive signal which is used at a time of a cleaning operation of the ejection head and whose frequency at which a drive pulse is generated is higher than that of the first drive signal, wherein the suction unit is actuated in association with an application of the second drive signal to the pressure generating element, wherein an elapsed-time measuring unit is provided for measuring the time elapsed from the time of previous actuation of the suction unit, and wherein the application controller applies the second drive signal to the pressure generating element on condition that the elapsed time measured by the elapsed-time measuring unit reaches a reference value for judgment.

27. The liquid ejecting apparatus according to claim 26, wherein the application controller sets the reference value for judgment by incorporating liquid-type information indicative of a type of liquid.

28. The liquid ejecting apparatus according to claim 26, wherein an environmental-condition detector is provided which is capable of detecting at least one of a temperature and humidity of a vicinity of the ejection head, and the application controller sets the reference value for judgment by incorporating a result of detection by the environmental-condition detector.

29. A liquid ejecting apparatus comprising:

an ejection head including a nozzle opening capable of ejecting a liquid, a pressure generating chamber communicating to the nozzle opening, and a pressure generating element for changing a pressure in the liquid inside the pressure generating chamber;

a drive signal generator for generating a drive signal including a drive pulse to be applied to the pressure generating element;

an application controller for controlling an application of the drive signal to the pressure generating element; and a suction unit for sucking the liquid in the ejection head through the nozzle opening, wherein the drive signal generator is capable of generating a first drive signal which is used when the liquid is ejected toward an object of ejection and a second drive signal which is used at a time of a cleaning operation of the ejection head and whose frequency at which a drive pulse is generated is higher than that of the first drive signal, wherein the suction unit is actuated in association with an application of the second drive signal to the pressure generating element, wherein an ejection-number counter is provided for counting the number of ejection of the liquid, and wherein the application controller applies the second drive signal to the pressure generating element on condition that the number of ejection counted by the ejection-number counter reaches a reference value for judgment.

30. The liquid ejecting apparatus according to claim 29, wherein the application controller sets the reference value for judgment by incorporating liquid-type information indicative of a type of liquid.

31. The liquid ejecting apparatus according to claim 29, wherein an environmental-condition detector is provided which is capable of detecting at least one of a temperature and humidity of a vicinity of the ejection head, and the application controller sets the reference value for judgment by incorporating a result of detection by the environmental-condition detector.

32. A liquid ejecting apparatus comprising:

an ejection head including a nozzle opening capable of ejecting a liquid, a pressure generating chamber communicating to the nozzle opening, and a pressure generating element for changing a pressure in the liquid inside the pressure generating chamber;

a first drive signal generator for generating a first drive signal including a drive pulse to be applied to the pressure generating element and used when the liquid is ejected toward an object of ejection;

a suction unit for sucking the liquid in the ejection head through the nozzle opening;

a vibration applying element for applying vibration to the liquid inside the pressure generating chamber by vibrating in a period according to the applied drive signal; and a second drive signal generator for generating a second drive signal including a drive pulse to be applied to the pressure generating element, whose frequency at which a drive pulse is generated is higher than that of the first drive signal; and an application controller for controlling an application of the second drive signal to the pressure generating element;

wherein the suction unit is actuated in association with an application of the second drive signal to the pressure generating element.

33. The liquid ejecting apparatus according to claim 32, wherein the suction unit includes a cap member having a sealed hollow portion which is open to a nozzle surface side of the ejection head, a negatively pressurizing unit communicating to the cap member to negatively pressurize the sealed hollow portion, and a negative-pressurization controller for controlling an actuation of the negatively pressurizing unit, and the nozzle surface is sealed with the nozzle opening opposed to an interior of the sealed hollow portion, and the negatively pressurizing unit is actuated in the sealed state to suck the liquid inside the ejection head.

34. The liquid ejecting apparatus according to claim 32, wherein the suction unit is actuated after application of the second drive signal to the pressure generating element.

35. The liquid ejecting apparatus according to claim 32, wherein the suction unit is actuated during the second drive signal is applied to the pressure generating element.

36. The liquid ejecting apparatus according to claim 35, wherein the cap member is capable of being disposed at a position spaced apart from the nozzle surface in a state that the sealed hollow portion is opposed to the nozzle surface, and the application controller applies the second drive signal to the pressure generating element in the spaced-apart state.

37. The liquid ejecting apparatus according to claim 35, wherein the application controller applies the second drive signal to the pressure generating element in a state that the nozzle surface is sealed by the cap member.

38. The liquid ejecting apparatus according to claim 37, wherein the application controller applies the second drive signal to the pressure generating element in a state that the liquid is accumulated in the sealed hollow portion.

39. The liquid ejecting apparatus according to claim 38, wherein the liquid is accumulated in the sealed hollow portion by actuating the negatively pressurizing unit in a state that the nozzle surface is sealed by the cap member.

40. The liquid ejecting apparatus according to claim 39, wherein the liquid accumulated in the sealed hollow portion and the nozzle surface are brought into contact with each other in the state that the nozzle surface is sealed by the cap member.

41. The liquid ejecting apparatus according to claim 37, wherein an opening-closing valve whose opening and closing are controlled by the negative-pressurization controller is provided midway in an open-to-atmosphere passage having one end communicating to the sealed hollow portion of the cap member and another end open to the atmosphere, and the negative-pressurization controller closes the opening-closing valve in the state that the nozzle surface is sealed by the cap member, and the negative-pressurization controller opens the opening-closing valve and actuates the negatively pressurizing unit when the sealing of the nozzle surface is released.

42. The liquid ejecting apparatus according to claim 32, wherein the application controller intermittently applies the second drive signal to the pressure generating element a plurality of times.

43. The liquid ejecting apparatus according to claim 32, wherein the application controller periodically effects application of the second drive signal and suction by the suction unit.

44. The liquid ejecting apparatus according to claim 43, wherein an elapsed-time measuring unit is provided for measuring the time elapsed from the time of previous actuation of the suction unit, and the application controller applies the second drive signal to the pressure generating element on condition that the elapsed time measured by the elapsed-time measuring unit reaches a reference value for judgment.

45. The liquid ejecting apparatus according to claim 32, wherein an ejection-number counter is provided for counting the number of ejection of the liquid, and the application controller applies the second drive signal to the pressure generating element on condition that the number of ejection counted by the ejection-number counter reaches a reference value for judgment.

46. The liquid ejecting apparatus according to claim 44, wherein the application controller sets the reference value for judgment by incorporating liquid-type information indicative of a type of liquid.

47. The liquid ejecting apparatus according to claim 44, wherein an environmental-condition detector is provided which is capable of detecting at least one of a temperature and humidity of a vicinity of the ejection head, and the application controller sets the reference value for judgment by incorporating a result of detection by the environmental-condition detector.

48. The liquid ejecting apparatus according to claim 45, wherein the application controller sets the reference value for judgment by incorporating liquid-type information indicative of a type of liquid.

49. The liquid ejecting apparatus according to claim 45, wherein an environmental-condition detector is provided which is capable of detecting at least one of a temperature and humidity of a vicinity of the ejection head, and the application controller sets the reference value for judgment by incorporating a result of detection by the environmental-condition detector.

50. The liquid ejecting apparatus according to claim 32, wherein the application controller applies the second drive signal on condition that the application controller receives an instruction signal for instructing the supply of the second drive signal.

51. The liquid ejecting apparatus according to claim 32, wherein a suction-force limiter is provided for limiting the suction force of the suction unit, and the suction-force limiter is arranged to be capable of being actuated in interlocking relation to the actuation of the suction unit.

52. The liquid ejecting apparatus according to claim 32, wherein a wiping mechanism for wiping the nozzle surface is provided.

53. The liquid ejecting apparatus according to claim 32, wherein at least one of a generation period and a drive voltage of the drive pulse is capable to be varied.

54. The liquid ejecting apparatus according to claim 32, wherein the frequency at which the drive pulse is generated in the second drive signal is set to not less than 30 kHz and not more than 200 kHz.

55. The liquid ejecting apparatus according to claim 32, wherein the frequency at which the drive pulse is generated in the second drive signal is set to not less than 80 kHz and not more than 120 kHz.

56. The liquid ejecting apparatus according to claim 32, wherein the pressure generating element is a piezoelectric vibrator.

57. The liquid ejecting apparatus according to claim 32, wherein the vibration applying element is attached to the ejection head.

58. The liquid ejecting apparatus according to claim 32, wherein the vibration applying element is provided so as to be capable of abut against the ejection head.

59. The liquid ejecting apparatus according to claim 32, wherein the first and second drive signal generator is formed integrally.

60. The liquid ejecting apparatus according to claim 32, wherein the first and second drive signal generator is formed separately.

61. A method of cleaning an ejection head having a pressure generating chamber communicating to a nozzle opening for ejecting a liquid and a pressure generating element for changing a pressure in the liquid inside the pressure generating chamber, the method comprising the steps of:

applying to the pressure generating element a second drive signal whose frequency at which a drive pulse is generated is higher than a first drive signal which is used when the liquid is ejected toward an object of ejection;

sucking the liquid in the ejection head through the nozzle opening in association with the supply of the second drive signal;

accumulating the liquid outside the ejection head; and bringing a nozzle surface side of the ejection head into contact with the accumulated liquid.

62. A method of cleaning an ejection head having a pressure generating chamber communicating to a nozzle opening for ejecting a liquid and a pressure generating element for changing a pressure in the liquid inside the pressure generating chamber, the method comprising the steps of:

applying to the pressure generating element a second drive signal whose frequency at which a drive pulse is generated is higher than a first drive signal which is used when the liquid is ejected toward an object of ejection; and sucking the liquid in the ejection head through the nozzle opening in association with the supply of the second drive signal, wherein the second drive signal is applied in a state that the liquid flows out from the nozzle opening.

63. The method according to claim 62, wherein the liquid in head ejection head is sucked during the second drive signal is applied to the pressure generating element.

64. A method of cleaning an ejection head having a pressure generating chamber communicating to a nozzle opening for ejecting a liquid, a pressure generating element for changing a pressure in the liquid inside the pressure generating chamber, and a vibration applying element for applying vibration to the liquid inside the pressure generating chamber, the method comprising the steps of:

applying to the pressure generating element a second drive signal whose frequency at which a drive pulse is generated is higher than a first drive signal which is used when the liquid is ejected toward an object of ejection; and sucking the liquid in the ejection head through the nozzle opening in association with the supply of the second drive signal.

65. The method according to claim 64, wherein the second drive signal is applied in a state that the liquid flows out from the nozzle opening.

66. The method according to claim 65, wherein the liquid in head ejection head is sucked during the second drive signal is applied to the pressure generating element.

* * * * *